US012104234B2

(12) United States Patent
Shiga et al.

(10) Patent No.: US 12,104,234 B2
(45) Date of Patent: Oct. 1, 2024

(54) STEEL MATERIAL

(71) Applicant: NIPPON STEEL CORPORATION, Tokyo (JP)

(72) Inventors: Akira Shiga, Tokyo (JP); Yutaka Neishi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 615 days.

(21) Appl. No.: 17/311,543

(22) PCT Filed: Dec. 27, 2019

(86) PCT No.: PCT/JP2019/051470
§ 371 (c)(1),
(2) Date: Jun. 7, 2021

(87) PCT Pub. No.: WO2020/138432
PCT Pub. Date: Jul. 2, 2020

(65) Prior Publication Data

US 2022/0106671 A1 Apr. 7, 2022

(30) Foreign Application Priority Data

Dec. 28, 2018 (JP) ..... 2018-246367

(51) Int. Cl.
*C22C 38/54* (2006.01)
*C22C 38/00* (2006.01)
(Continued)

(52) U.S. Cl.
CPC ..... *C22C 38/54* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01)

(58) Field of Classification Search
CPC ..... C22C 38/54
See application file for complete search history.

(56) References Cited

U.S. PATENT DOCUMENTS

2013/0146180 A1 6/2013 Kubota
2014/0014234 A1 1/2014 Okamoto et al.

FOREIGN PATENT DOCUMENTS

JP 2012207244 A 10/2012
WO 2012108460 A1 8/2012
WO WO-2015147067 A1 * 10/2015 ..... C21D 1/06

* cited by examiner

*Primary Examiner* — Christopher S Kessler
(74) *Attorney, Agent, or Firm* — Greer, Burns & Crain, Ltd.

(57) ABSTRACT

There is provided a steel material that has a high critical working ratio in cold forging and has a high fatigue strength and an excellent hydrogen embrittlement resistance when the steel material is formed into a carburized-steel component. The steel material according to the present embodiment has a chemical composition that contains, in mass %, C: 0.07 to 0.13%, Si: 0.15 to 0.35%, Mn: 0.60 to 0.80%, S: 0.005 to 0.050%, Cr: 1.90 to 2.50%, B: 0.0005 to 0.0100%, Ti: 0.010 to less than 0.050%, Al: 0.010 to 0.100%, Ca: 0.0002% to 0.0030%, N: 0.0080% or less, P: 0.050% or less, and O: 0.0030% or less, with the balance being Fe and impurities, and satisfies Formula (1) to Formula (5) described in the specification.

2 Claims, 3 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

STEEL MATERIAL

This is a National Phase Application filed under 35 U.S.C. § 371, of International Application No. PCT/JP2019/051470, filed Dec. 27, 2019, the contents of which are incorporated by reference.

TECHNICAL FIELD

The present invention relates to a steel material, more particularly to a steel material to be a starting material of a carburized-steel component.

BACKGROUND ART

In general, a steel material to be a starting material of a component for machine structural use contains Mn, Cr, Mo, and Ni, and the like. A steel material containing chemical components including these elements and produced through processes including casting, forging, rolling, and the like is subjected to machining such as forging and cutting to be shaped, and further subjected to carburizing treatment into a carburized-steel component including a carburized layer in a surface layer portion and a core portion inner than the carburized layer. In the present description, the carburizing treatment includes carbonitriding treatment unless otherwise noted.

Of costs of producing the carburized-steel component, a cost relating to cutting is extremely high. For cutting, cutting tools are expensive. Moreover, cutting is disadvantageous from a viewpoint of yield because cutting produces chips in large amount. Hence, an attempt has been made to substitute forging for cutting. Method for forging can be roughly categorized into hot forging, warm forging, and cold forging. Features of the warm forging are that the warm forging produces a few scales and that the warm forging improves dimensional accuracy more than the hot forging. Features of the cold forging are that the cold forging produces a few scales and that the cold forging gives a dimensional accuracy close to that given by conventional cutting. Studied methods thus include a method in which rough processing is performed in a form of hot forging and then finish processing is performed in a form of cold forging, a method in which warm forging is performed and then mild cutting is performed as finishing, a method in which cold forging is performed and then mild cutting is performed as finishing, and the like. However, in a case where hot forging is substituted by warm forging or cold forging, if a steel material for a carburized-steel component has high deformation resistance, the steel material increases interfacial pressure applied to dies of a forging machine, which shortens a life of the dies. In this case, although an amount of cutting is reduced, cost advantage is not very great. Moreover, in a case where a material is formed into a complex shape, a crack can occur in a region where heavy processing is applied. Therefore, in a case where a carburized-steel component is produced by warm forging or cold forging, it is desired to increase a critical working ratio of a steel material for a carburized-steel component.

International Application Publication No. 2012/108460 (Patent Literature 1) and Japanese Patent Application Publication No. 2012-207244 (Patent Literature 2) each propose a steel material that is to be a starting material of a carburized-steel component and serves a purpose of enhancing cold forgeability (critical working ratio).

The steel to be carburized described in Patent Literature 1 includes chemical components containing, in mass %, C: 0.07% to 0.13%, Si: 0.0001% to 0.50%, Mn: 0.0001% to 0.80%, S: 0.0001% to 0.100%, Cr: more than 1.30% to 5.00%, B: 0.0005% to 0.0100%, Al: 0.0001% to 1.0%, and Ti: 0.010% to 0.10%, and limiting such that N: 0.0080% or less, P: 0.050% or less, and O: 0.0030% or less, with the balance being Fe and unavoidable impurities, and in the chemical components, contents of elements in mass % satisfy Formula (1) to Formula (3). Here, Formula (1) to Formula (3) are as follows. $0.10<C+0.194\times Si+0.065\times Mn+0.012\times Cr+0.078\times Al<0.235$ Formula (1), $7.5<(0.7\times Si+1)\times(5.1\times Mn+1)\times(2.16\times Cr+1)<44$ Formula (2), and $0.004<Ti-N\times(48/14)<0.030$ Formula (3). Patent Literature 1 describes that, with the chemical composition, a critical working ratio in cold forging of this steel to be carburized can be increased, and additionally a quench-hardened layer and a core portion hardness that are same as those of a conventional steel are obtained after carburizing treatment.

A case hardening steel described in Patent Literature 2 contains, in mass %, C: 0.05 to 0.20%, Si: 0.01 to 0.1%, Mn: 0.3 to 0.6%, P: 0.03% or less (0% excluded), S: 0.001 to 0.02%, Cr: 1.2 to 2.0%, Al: 0.01 to 0.1%, Ti: 0.010 to 0.10%, N: 0.010% or less (0% excluded), and B: 0.0005 to 0.005%, with the balance being iron and unavoidable impurities, wherein a density of Ti-based precipitates each having circle-equivalent diameters of less than 20 nm is 10 to $100/\mu m^2$, a density of Ti-based precipitates each having a circle-equivalent diameter of 20 nm or more is 1.5 to $10/\mu m^2$, and a Vickers hardness is 130 HV or less. Patent Literature 2 describes that this case hardening steel having the configuration described above is excellent in cold forgeability.

CITATION LIST

Patent Literature

Patent Literature 1: International Application Publication No. 2012/108460

Patent Literature 2: Japanese Patent Application Publication No. 2012-207244

SUMMARY OF INVENTION

Technical Problem

Of components for machine structural use, those applicable to an automobile include a plurality of kinds of large carburized-steel components. Examples of large carburized-steel components applied to an automobile include variable pulleys of a continuously variable transmission (CVT). In particular, in a case where a large carburized-steel component is used as an important safety related part, the large carburized-steel component is required to have a high fatigue strength. In a case where a large carburized-steel component is produced from a steel material disclosed in each of Patent Literature 1 and Patent Literature 2, there is a case where a hardness of a core portion of the carburized-steel component cannot be increased sufficiently, resulting in a failure to obtain the high fatigue strength.

Furthermore, in a case where a carburized-steel component is applied to a shaft for a transmission of an automobile or industrial equipment, the carburized-steel component is used while being in contact with lubricant (with the lubricant applied to the carburized-steel component). In this case, hydrogen originating from the lubricant tends to cause delayed fracture in the carburized-steel component. Therefore, a carburized-steel component is required to have a high core portion hardness and an excellent hydrogen embrittlement resistance.

An objective of the present disclosure is to provide a steel material that has a high critical working ratio in cold forging and has a high fatigue strength and an excellent hydrogen embrittlement resistance when the steel material is formed into a carburized-steel component.

Solution to Problem

A steel material according to the present disclosure includes a chemical composition containing, in mass %:

C: 0.07 to 0.13%;
Si: 0.15 to 0.35%;
Mn: 0.60 to 0.80%;
S: 0.005 to 0.050%;
Cr: 1.90 to 2.50%;
B: 0.0005 to 0.0100%;
Ti: 0.010 to less than 0.050%;
Al: 0.010 to 0.100%;
Ca: 0.0002 to 0.0030%;
N: 0.0080% or less;
P: 0.050% or less; and
O: 0.0030% or less, with the balance being Fe and impurities, and satisfying Formula (1) to Formula (5):

$$0.140<C+0.194\times Si+0.065\times Mn+0.012\times Cr+0.033\times Mo+0.067\times Ni+0.097\times Cu+0.078\times Al<0.235 \quad (1)$$

$$1.35<(1.33\times C-0.1)+(0.23\times Si+0.01)+(0.42\times Mn+0.22)+(0.27\times Cr+0.22)+(0.77\times Mo+0.03)+(0.12\times Ni+0.01)<1.55 \quad (2)$$

$$0.004<Ti-N\times(48/14)<0.030 \quad (3)$$

$$0.035\leq Ca/S\leq 0.15 \quad (4)$$

$$Mn/(Si+Cr+Mo+Ni)<0.30 \quad (5)$$

where a symbols of each element in Formula (1) to Formula (5) is to be substituted by contents of the corresponding element (mass %) or to be substituted by "0" when the corresponding element is not contained.

Advantageous Effect of Invention

The steel material according to the present disclosure has a high critical working ratio in cold forging and has a high fatigue strength and an excellent hydrogen embrittlement resistance when the steel material is formed into a carburized-steel component.

DESCRIPTION OF EMBODIMENT

Figure 1:
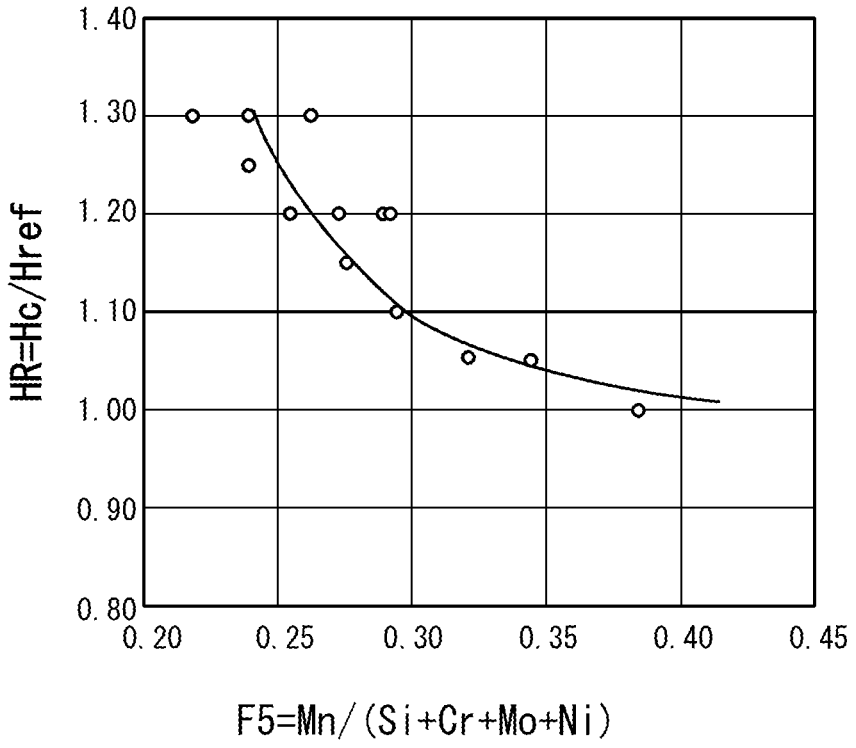
FIG. 1 is a graph illustrating a relation between critical diffusible hydrogen amount ratio HR and F5=Mn/(Si+Cr+Mo+Ni) in a steel material of which contents of elements are within corresponding ranges according to the present embodiment.

The present inventors conducted studies regarding how to improve a critical working ratio of a steel material to be a starting material of a carburized-steel component and regarding how to increase a fatigue strength and a hydrogen embrittlement resistance of the steel material when the steel material is subjected to cold forging and carburizing treatment to be formed into a carburized-steel component. As a result, the present inventors obtained the following findings (A) to (G).

(A) A critical working ratio of a steel material before cold forging can be increased as a content of C of the steel material decreases. However, an excessively low content of C makes it difficult to bring a fatigue strength of a carburized-steel component subjected to carburizing treatment on a par with that of a conventional steel material of which a content of C is about 0.20% (e.g., SCR420 defined in JIS G 4052(2008)). By making a chemical composition of a steel material contain, in mass %, C: 0.07 to 0.13%, Si: 0.15 to 0.35%, Mn: 0.60 to 0.80%, S: 0.005 to 0.050%, Cr: 1.90 to 2.50%, B: 0.0005 to 0.0100%, Ti: 0.010 to less than 0.050%, Al: 0.010 to 0.100%, Ca: 0.0002% to 0.0030%, N: 0.0080% or less, P: 0.050% or less, O: 0.0030% or less, Nb: 0 to 0.100%, V: 0 to 0.300%, Mo: 0 to 0.500%, Ni: 0 to 0.500%, Cu: 0 to 0.500%, Mg: 0 to 0.0035%, and rare earth metal (REM): 0 to 0.005%, with the balance being Fe and impurities, there is a possibility that a core portion hardness necessary for a large carburized-steel component can be obtained and a sufficient fatigue strength is obtained even when a content of C of the steel material is lower than that of a conventional steel material.

(B) In order to obtain a high core portion hardness and a sufficient fatigue strength of the steel material having the above-described chemical composition, it is preferable to increase a fraction of martensite of a microstructure in a core portion of a carburized-steel component. For increasing a fraction of martensite of a microstructure in a core portion of a carburized-steel component, it is effective to make the steel material contain alloying elements such as C, Si, Mn, Cr, Mo, and Ni, each of which enhances a hardenability of a steel, (hardenability enhancing elements) such that contents of the quenching enhancing elements satisfy Formula (2):

$$1.35<(1.33\times C-0.1)+(0.23\times Si+0.01)+(0.42\times Mn+0.22)+(0.27\times Cr+0.22)+(0.77\times Mo+0.03)+(0.12\times Ni+0.01)<1.55 \quad (2)$$

where a symbol of each element in Formula (2) is to be substituted by a content of the corresponding element (mass %).

(C) However, as the contents of the hardenability enhancing elements are increased, the hardenability enhancing elements subject ferrite to solid-solution strengthening. This increases a hardness of the steel material. As a hardness of a steel material is increased, cold forgeability is decreased, and a critical working ratio is decreased.

B (boron) is an element that increases hardenability of a steel material but does not subject ferrite to solid-solution strengthening. Therefore, the above-described chemical composition of the steel material is made to contain B at 0.0005 to 0.0100%, as described above. In addition, the contents of the above-described hardenability enhancing elements are made to satisfy Formula (1). This makes it possible to obtain a sufficient core portion hardness and a sufficient fatigue strength of a carburized-steel component produced by performing carburizing treatment on a steel material while preventing or reducing a decrease in a critical working ratio of the steel material.

$$0.140<C+0.194\times Si+0.065\times Mn+0.012\times Cr+0.033\times Mo+0.067\times Ni+0.097\times Cu+0.078\times Al<0.235 \quad (1)$$

where a symbol of each element in Formula (1) is to be substituted by a content of the corresponding element (mass %).

(D) In order to obtain a hardenability enhancing effect of B stably, it is necessary to keep sufficient dissolved B in a steel material in carburizing treatment. Therefore, the steel material is made to contain Ti, as described above. In this case, N contained in the steel material is mostly immobilized in a form of TiN in carburizing treatment. This prevents or reduces binding between B and N, thereby keeping sufficient dissolved B in the steel material. In order to obtain the above-described effect, a content of Ti in the steel material is made to satisfy Formula (3):

$$0.004<Ti-N\times(48/14)<0.030 \quad (3)$$

where a symbol of each element in Formula (3) is to be substituted by a content of the corresponding element (mass %).

When a content of Ti and a content of N in the chemical composition of the steel material satisfy Formula (3), N combines with Ti to form TiN. This prevents or reduces a decrease in the dissolved B due to combination of N with the dissolved B, which can keep the sufficient dissolved B in the steel material. In addition, Ti that has not combined with N finely disperses and precipitates in a form of TiC in the steel material. This prevents or reduces abnormal grain growth of austenite grains during carburizing treatment. Thus, occurrence of coarse prior-austenite grains can be prevented or reduced in a core portion of a carburized-steel component, and a sufficient hardness is obtained.

(E) B increases a hardenability of a core portion of a carburized-steel component effectively. However, in a case where gas carburizing is performed in an endothermic gas system, a hardenability enhancing effect by contained B is minor in a carburized layer that is a surface layer portion of a carburized-steel component. This is because nitrogen enters through a surface of the steel component in carburizing treatment, combining with dissolved B to precipitate in a form of BN, which decreases an amount of the dissolved B. Therefore, to ensure a hardenability in the carburized layer that is a surface layer portion of the carburized-steel component, the chemical composition of the steel material is made to satisfy Formula (2), as described above.

(F) In a case where a carburized-steel component is produced from a steel material, the steel material subjected to cold forging may be subjected to cutting. In the present embodiment, as described in the above chemical composition, a content of S is set at 0.005 to 0.050%. This causes formation of MnS, which increases machinability of the steel material. However, if MnS is elongated, cold forgeability is decreased. Therefore, a content of Ca is set at 0.0002 to 0.0030% and made to satisfy Formula (4). In this case, sulfide in the steel material is refined and spheroidized. This increases cold forgeability of the steel material, increasing a critical working ratio of the steel.

$$0.03\leq Ca/S\leq 0.15 \quad (4)$$

where a symbol of each element in Formula (4) is to be substituted by a content of the corresponding element (mass %).

(G) In a steel material of which a content of C is 0.13% or less, a content of Cr is 1.90% or more, and a content of B is 0.0005 to 0.0100%, when a content of Mn is reduced with respect to a total content of Si, Cr, Mo, and Ni, entry of hydrogen from the outside can be prevented or reduced, which increases hydrogen embrittlement resistance. Specifically, on an assumption that the amounts of the elements are within the corresponding ranges according to the present embodiment and satisfy Formula (1) to Formula (4), and additionally the amounts of the elements are made to satisfy Formula (5). In this case, a carburized-steel component produced from the steel material having the above-described chemical composition has an excellent hydrogen embrittlement resistance.

$$Mn/(Si+Cr+Mo+Ni)<0.30 \quad (5)$$

where a symbol of each element in Formula (5) is to be substituted by a content of the corresponding element (mass %).

The steel material according to the present embodiment completed based on the above findings has the following configuration.

[1] A steel material including a chemical composition containing, in mass %:

C: 0.07 to 0.13%;
Si: 0.15 to 0.35%;
Mn: 0.60 to 0.80%;
S: 0.005 to 0.050%;
Cr: 1.90 to 2.50%;
B: 0.0005 to 0.0100%;
Ti: 0.010 to less than 0.050%;
Al: 0.010 to 0.100%;
Ca: 0.0002 to 0.0030%;
N: 0.0080% or less;
P: 0.050% or less; and
O: 0.0030% or less,
with the balance being Fe and impurities, and satisfying Formula (1) to Formula (5):

$$0.140<C+0.194\times Si+0.065\times Mn+0.012\times Cr+0.033\times Mo+0.067\times Ni+0.097\times Cu+0.078\times Al<0.235 \quad (1)$$

$$1.35<(1.33\times C-0.1)+(0.23\times Si+0.01)+(0.42\times Mn+0.22)+(0.27\times Cr+0.22)+(0.77\times Mo+0.03)+(0.12\times Ni+0.01)<1.55 \quad (2)$$

$$0.004<Ti-N\times(48/14)<0.030 \quad (3)$$

$$0.03\leq Ca/S\leq 0.15 \quad (4)$$

$$Mn/(Si+Cr+Mo+Ni)<0.30 \quad (5)$$

where a symbol of each element in Formula (1) to Formula (5) is to be substituted by contents of the corresponding element (mass %) or to be substituted by "0" when the corresponding element is not contained.

[2] The steel material according to [1], wherein the chemical composition contains, in lieu of a part of Fe, one or more elements selected from the group consisting of:

Nb: 0.100% or less;
V: 0.300% or less;
Mo: 0.500% or less;
Ni: 0.500% or less;
Cu: 0.500% or less;
Mg: 0.0035% or less; and
rare earth metal (REM): 0.005% or less.

[3] The steel material according to [1], wherein the chemical composition contains, in lieu of a part of Fe, one or more elements selected from the group consisting of:

Nb: 0.002 to 0.100%;

V: 0.001 to 0.300%;

Mo: 0.005 to 0.500%;

Ni: 0.005 to 0.500%;

Cu: 0.005 to 0.500%

Mg: 0.0001 to 0.0035%; and rare earth metal (REM): 0.001 to 0.005%.

The steel material according to the present embodiment will be described below in detail. The symbol "%" used herein for elements herein means mass % unless otherwise noted.

[Chemical Composition of Steel Material]

The steel material according to the present embodiment is a starting material of a carburized-steel component. The steel material according to the present embodiment is subjected to cold forging and then to carburizing treatment to be formed into a carburized-steel component. A chemical composition of the steel material according to the present embodiment contains the following elements.

C: 0.07 to 0.13%

Carbon (C) increases hardness of a core portion of a carburized-steel component, increasing fatigue strength. If a content of C is less than 0.07%, hardness of a core portion of a carburized-steel component is decreased, and fatigue strength is decreased, even when contents of other elements are within respective ranges according to the present embodiment. On the other hand, in the steel material according to the present embodiment, the content of C is set at 0.13% or less to increase a critical working ratio, whereas a content of C in a conventional steel material used for a carburized-steel component is about 0.20%. Therefore, the content of C is 0.07 to 0.13%. A lower limit of the content of C is preferably 0.08%, more preferably 0.09%. An upper limit of the content of C is preferably 0.12%, more preferably 0.11%.

Si: 0.15 to 0.35%

Silicon (Si) increases temper softening resistance of a carburized-steel component, increasing fatigue strength of the carburized-steel component. If a content of Si is less than 0.15%, this effect is not obtained sufficiently even when contents of other elements are within respective ranges according to the present embodiment. On the other hand, if the content of Si is more than 0.35%, hardness of a steel material before subjected to cold forging becomes excessively high, which decreases critical working ratio even when contents of other elements are within respective ranges according to the present embodiment. Therefore, the content of Si is 0.15 to 0.35%. From a viewpoint of further increasing fatigue strength, a lower limit of the content of Si is preferably 0.16%, more preferably 0.17%, still more preferably 0.18%, even still more preferably 0.20%. From a viewpoint of further increasing a critical working ratio, an upper limit of the content of Si is preferably 0.30%, more preferably 0.28%, still more preferably 0.25%.

Mn: 0.60 to 0.80%

Manganese (Mn) increases hardenability of steel, increases core portion hardness of a carburized-steel component, and increases fatigue strength. If a content of Mn is less than 0.60%, a sufficient hardenability is not obtained even when contents of other elements are within respective ranges according to the present embodiment. On the other hand, if the content of Mn is excessively high, hardness of a steel material before subjected to cold forging becomes excessively high, which decreases critical working ratio even when contents of other elements are within respective ranges according to the present embodiment. Therefore, the content of Mn is 0.60 to 0.80%. A lower limit of the content of Mn is preferably 0.61%, more preferably 0.62%, still more preferably 0.65%. An upper limit of the content of Mn is preferably 0.77%, more preferably 0.75%.

S: 0.005 to 0.050%

Sulfur (S) combines with Mn in steel to form MnS, increasing machinability of a steel material. If a content of S is less than 0.005%, this effect is not obtained sufficiently even when contents of other elements are within respective ranges according to the present embodiment. On the other hand, if the content of S is more than 0.050%, MnS serves as origins of cracks in cold forging, which decreases a critical working ratio of a steel material even when contents of other elements are within respective ranges according to the present embodiment. Therefore, the content of S is 0.005 to 0.050%. A lower limit of the content of S is preferably 0.006%, more preferably 0.008%, still more preferably less than 0.010%. An upper limit of the content of S is preferably 0.040%, more preferably 0.030%, still more preferably 0.025%, even still more preferably 0.020%.

Cr: 1.90 to 2.50%

Chromium (Cr) increases hardenability of steel, increases core portion hardness of a carburized-steel component, and increases fatigue strength. As compared with Mn, Mo, and Ni, which increase hardenability, Cr can increase hardenability of a steel material while suppressing a rise in hardness of the steel material. If a content of Cr is less than 1.90%, a sufficient hardenability is not obtained even when contents of other elements are within respective ranges according to the present embodiment. On the other hand, if the content of Cr is more than 2.50%, hardness of a steel material before subjected to cold forging becomes excessively high, which decreases a critical working ratio of the steel material even when contents of other elements are within respective ranges according to the present embodiment. Therefore, the content of Cr is 1.90 to 2.50%. A lower limit of the content of Cr is preferably 1.92%, more preferably 1.94%, still more preferably 1.96%, even still more preferably 2.00%. An upper limit of the content of Cr is preferably 2.45%, more preferably 2.40%, still more preferably 2.35%, even still more preferably 2.30%.

B: 0.0005 to 0.0100%

When being dissolved in austenite, boron (B) significantly increases hardenability of steel even in trace amounts. Boron therefore increases a core portion hardness of a carburized-steel component and increases fatigue strength. Moreover, B contained in trace amounts exerts these effects and thus does not tend to increase hardness of ferrite in a steel material. In other words, hardenability of a steel material can be increased while a critical working ratio of the steel material is kept high. If a content of B is less than 0.0005%, these effects are not obtained sufficiently even when contents of other elements are within respective ranges according to the present embodiment. On the other hand, if the content of B is more than 0.0100%, these effects is saturated. Therefore, the content of B is 0.0005 to 0.0100%. A lower limit of the content of B is preferably 0.0007%, more preferably 0.0010%, still more preferably 0.0012%, even still more preferably 0.0014%. An upper limit of the content of B is preferably 0.0080%, more preferably 0.0060%, still more preferably 0.0050%, even still more preferably 0.0040%, yet even still more preferably 0.0030%.

Ti: 0.010 to Less than 0.050%

Titanium (Ti) immobilizes N in steel in a form of TiN. This can prevent or reduce formation of BN, keeping dissolved B. In addition, Ti combines with C to form TiC, preventing or reducing coarsening of austenite grains by the pinning effect in heating for carburizing treatment. If a content of Ti is less than 0.010%, these effects cannot be obtained sufficiently even if the other element contents fall within respective ranges in the present embodiment. On the other hand, if the content of Ti is 0.050% or more, TiC is produced excessively even when contents of other elements are within respective ranges according to the present embodiment. In this case, hardness of a steel material before subjected to cold forging becomes excessively high, which decreases a critical working ratio of the steel material. Therefore, the content of Ti is 0.010 to less than 0.050%. A lower limit of the content of Ti is preferably 0.015%, more preferably 0.018%, still more preferably 0.020%, even still more preferably 0.022%, yet even still more preferably 0.024%, yet even still more preferably 0.025%. An upper limit of the content of Ti is preferably 0.048%, more preferably 0.045%.

Al: 0.010 to 0.100%

Aluminum (Al) deoxidizes steel. In addition, Al combines with N to form AlN, preventing or reducing coarsening of austenite grains by the pinning effect in heating for carburizing treatment. This increases fatigue strength of a carburized-steel component. If a content of Al is less than 0.010%, these effects cannot be obtained sufficiently even if the other element contents fall within respective ranges in the present embodiment. On the other hand, if the content of Al is more than 0.100%, coarse Al oxide is formed in steel, decreasing fatigue strength of a carburized-steel component even when contents of other elements are within respective ranges according to the present embodiment. Therefore, the content of Al is 0.010 to 0.100%. A lower limit of the content of Al is preferably 0.014%, more preferably 0.018%, still more preferably 0.020%. An upper limit of the content of Al is preferably 0.090%, more preferably 0.070%, still more preferably 0.060%, even still more preferably 0.050%, yet even still more preferably 0.040%.

Ca: 0.0002 to 0.0030%

Calcium (Ca) is dissolved in sulfide in steel, refining and spheroidizing the sulfide. This increases cold forgeability of a steel material, increasing a critical working ratio of the steel material. If a content of Ca is less than 0.0002%, this effect is not obtained sufficiently even when contents of other elements are within respective ranges according to the present embodiment. On the other hand, if the content of Ca is more than 0.0030%, coarse Ca oxide is produced in steel even when contents of other elements are within respective ranges according to the present embodiment. In this case, a critical working ratio of a steel material is rather decreased. Therefore, the content of Ca is 0.0002 to 0.0030%. A lower limit of the content of Ca is preferably 0.0005%, more preferably 0.0007%. An upper limit of the content of Ca is preferably 0.0025%, more preferably 0.0022%, still more preferably 0.0020%.

N: 0.0080% or Less

Nitrogen (N) is an impurity contained unavoidably. In other words, a content of N is more than 0%. N combines with B to form BN, decreasing dissolved B. If a content of N is more than 0.0080%, it becomes difficult for Ti to immobilize N sufficiently, resulting in excessive production of BN even when a content of Ti in a steel material is within a corresponding range according to the present embodiment. As a result, hardenability of the steel material is decreased. The content of N being more than 0.0080% further causes production of coarse TiN, and the coarse TiN serves as origins of cracks in cold forging. As a result, a critical working ratio of a steel material is decreased. Therefore, the content of N is 0.0080% or less. An upper limit of the content of N is preferably 0.0075%, more preferably 0.0070%, still more preferably 0.0065%. The content of N is preferably made as low as possible. However, an excessive reduction of the content of N increases a production cost. Therefore, with consideration given to usual industrial production, a lower limit of the content of N is preferably 0.0001%, more preferably 0.0005%, still more preferably 0.0010%, even still more preferably 0.0030%.

P: 0.050% or Less

Phosphorus (P) is an impurity contained unavoidably. In other words, a content of P is more than 0%. P decreases hot workability of a steel material. Moreover, P decreases fatigue strength of a carburized-steel component. Therefore, the content of P is 0.050% or less. An upper limit of the content of P is preferably 0.035%, more preferably 0.028%, still more preferably 0.020%. The content of P is preferably as low as possible. However, an excessive reduction of the content of P increases a production cost. Therefore, with consideration given to usual industrial production, a lower limit of the content of P is preferably 0.001%, more preferably 0.005%.

O: 0.0030% or Less

Oxygen (O) is an impurity contained unavoidably. In other words, a content of O is more than 0%. Moreover, O forms oxides, which decreases a critical working ratio of a steel material and decreases fatigue strength of a carburized-steel component. Therefore, the content of O is 0.0030% or less. An upper limit of the content of O is preferably 0.0028%, more preferably 0.0026%, still more preferably 0.0023%. The content of O is preferably as low as possible. However, an excessive reduction of the content of O increases a production cost. Therefore, with consideration given to usual industrial production, a lower limit of the content of O is preferably 0.0001%, more preferably 0.0005%, still more preferably 0.0007%.

The balance of the chemical composition of the steel material according to the present embodiment is Fe and impurities. The term "impurities" as used herein means impurities that are mixed in a steel material from raw materials such as ores and scraps or from a production environment when the steel material is produced industrially, and that are allowed to be mixed in the steel material within ranges in which the impurities have no adverse effect on the steel material according to the present embodiment.

[Optional Elements]

The chemical composition of the steel material for a carburized-steel component according to the present embodiment may further contain, in lieu of a part of Fe, one or more elements selected from the group consisting of Nb, V, Mo, Ni, Cu, Mg, and rare earth metal (REM). Of these elements, any of Nb, V, Mo, Ni, Cu, and Mg increases fatigue strength of a carburized-steel component of which a starting material is the steel material. Specifically, Nb and V form their carbides and/or carbo-nitrides to increase strength of a core portion of a carburized-steel component, increasing fatigue strength of the carburized-steel component. Mo, Ni, and Cu increase hardenability of a steel material, increasing strength of a carburized-steel component. Mg refines oxide to prevent or reduce occurrence of cracks attributable to coarse oxide, thereby increasing fatigue strength of a carburized-steel component. Of the above-described elements, REM governs morphology of sulfide, increasing a critical working ratio of a steel material.

Nb: 0.100% or Less

Niobium (Nb) is an optional element and need not be contained. In other words, a content of Nb may be 0%. When contained, Nb combines with C and N to form its carbide and/or carbo-nitride, preventing or reducing coarsening of austenite grains by the pinning effect during heating in carburizing treatment. Even a trace amount of Nb contained can provide this effect to some extent. However, if the content of Nb is more than 0.100%, Nb produces its coarse carbide and/or its carbo-nitride, decreasing a critical working ratio of a steel material. Therefore, the content of Nb is 0.100% or less. In other words, the content of Nb is O to 0.100%. A lower limit of the content of Nb is preferably 0.001%, more preferably 0.002%, still more preferably 0.004%, even still more preferably 0.010%. An upper limit of the content of Nb is preferably 0.080%, more preferably 0.060%, still more preferably 0.050%.

V: 0.300% or Less

Vanadium (V) is an optional element and need not be contained. In other words, a content of V may be 0%. When contained, V forms its carbide in a steel material to precipitate in ferrite, increasing strength of a core portion of a carburized-steel component. Even a trace amount of V contained can provide this effect to some extent. However, if the content of V is more than 0.300%, cold forgeability of a steel material is decreased, which decreases a critical working ratio of the steel material. Therefore, the content of V is 0.300% or less. In other words, the content of V is 0 to 0.300%. A lower limit of the content of V is preferably 0.001%, more preferably 0.003%, still more preferably 0.004%, even still more preferably 0.005%. An upper limit of the content of V is preferably 0.280%, more preferably 0.250%, still more preferably 0.230%, even still more preferably 0.200%, yet even still more preferably 0.180%, yet even still more preferably 0.150%, yet even still more preferably 0.130%, yet even still more preferably 0.100%.

Mo: 0.500% or Less

Molybdenum (Mo) is an optional element and need not be contained. In other words, a content of Mo may be 0%. When contained, Mo increases hardenability of steel, increasing a fraction of martensite of a carburized-steel component. Moreover, in a case where carburizing treatment is performed by gas carburizing, Mo does not produce its oxide nor its nitride in the carburizing treatment. For that reason, Mo prevents or reduces production of an oxide layer, a nitride layer, and an abnormal surface layer in a carburized layer. Even a trace amount of Mo contained can provide these effects to some extent. However, if the content of Mo is more than 0.500%, hardness of a steel material is increased excessively, which decreases a critical working ratio of the steel material. Therefore, the content of Mo is 0.500% or less. In other words, the content of Mo is 0 to 0.500%. A lower limit of the content of Mo is preferably 0.001%, more preferably 0.005%, still more preferably 0.010%, even still more preferably 0.020%, yet even still more preferably 0.050%. An upper limit of the content of Mo is preferably 0.400%, more preferably 0.300%, still more preferably 0.200%.

Ni: 0.500% or Less

Nickel (Ni) is an optional element and need not be contained. In other words, a content of Ni may be 0%. When contained, Ni increases hardenability of steel, increasing a fraction of martensite of a carburized-steel component. Moreover, in a case where carburizing treatment is performed by gas carburizing, Ni does not produce its oxide nor its nitride in the carburizing treatment. For that reason, Ni prevents or reduces production of an oxide layer, a nitride layer, and an abnormal surface layer in a carburized layer. Even a trace amount of Ni contained can provide this effect to some extent. However, if the content of Ni is more than 0.500%, hardness of a steel material is increased excessively, which decreases a critical working ratio of the steel material. Therefore, the content of Ni is 0.500% or less. In other words, the content of Ni is 0 to 0.500%. A lower limit of the content of Ni is preferably 0.001%, more preferably 0.005%, still more preferably 0.010%, even still more preferably 0.020%, yet even still more preferably 0.050%. An upper limit of the content of Ni is preferably 0.400%, more preferably 0.300%, still more preferably 0.200%.

Cu: 0.500% or Less

Copper (Cu) is an optional element and need not be contained. In other words, a content of Cu may be 0%. When contained, Cu increases hardenability of steel, increasing a fraction of martensite of a carburized-steel component. Moreover, in a case where carburizing treatment is performed by gas carburizing, Cu does not produce its oxide nor its nitride in the carburizing treatment. For that reason, Cu prevents or reduces formation of an oxide layer, a nitride layer, and an abnormal surface layer in a carburized layer surface. Even a trace amount of Cu contained can provide this effect to some extent. However, if the content of Cu is more than 0.500%, hardness of a steel material is increased excessively, which decreases a critical working ratio of the steel material. Therefore, the content of Cu is 0.500% or less. In other words, the content of Cu is 0 to 0.500%. A lower limit of the content of Cu is preferably 0.001%, more preferably 0.005%, still more preferably 0.010%, even still more preferably 0.020%, yet even still more preferably 0.050%. An upper limit of the content of Cu is preferably 0.400%, more preferably 0.300%. In a case where Cu is contained, by setting a content of Ni to be ½ of the content of Cu or more, hot workability of a steel material is further increased.

Mg: 0.0035% or Less

Magnesium (Mg) is an optional element and need not be contained. In other words, a content of Mg may be 0%. When contained, as with Al, Mg deoxidizes steel and refines oxide in a steel material. When oxide in a steel material is refined, coarse oxide resists being produced. Coarse oxide can serve as an origin of a fracture. Therefore, refining of oxide by Mg prevents or reduces production of coarse oxide serving as a fracture origin. As a result, fatigue strength of a carburized-steel component is increased. Even a trace amount of Mg contained can provide this effect. However, if a content of Mg is more than 0.0035%, coarse oxide is produced in a steel material. In this case, a critical working ratio of a steel material is rather decreased. Therefore, the content of Mg is 0.0035% or less. In other words, the content of Mg is 0 to 0.0035%. A lower limit of the content of Mg is preferably 0.0001%, more preferably 0.0003%, still more preferably 0.0005%. An upper limit of the content of Mg is preferably 0.0032%, more preferably 0.0030%, still more preferably 0.0028%, even still more preferably 0.0025%.

The chemical composition of the steel material according to the present embodiment may further contain, in lieu of a part of Fe, rare earth metal (REM).

Rare Earth Metal (REM): 0.005% or Less

Rare earth metal (REM) is an optional element and need not be contained. In other words, a content of REM may be 0%. When contained, REM is dissolved in sulfide in steel, governing morphology of the sulfide. As a result, REM increases a critical working ratio of a steel material. Even a trace amount of REM contained can provide this effect to some extent. However, if the content of REM is more than 0.005%, coarse oxide is produced, decreasing fatigue strength of a carburized-steel component. Therefore, the content of REM is 0.005% or less. In other words, the content of REM is 0 to 0.005%. A lower limit of the content of REM is preferably 0.001%, more preferably 0.002%. An upper limit of the content of REM is preferably 0.004%.

Note that REM herein refers to one or more elements selected from the group consisting of Scandium (Sc) with atomic number 21, yttrium (Y) with atomic number 39, and lanthanoid including lanthanum (La) with atomic number 57 to lutetium (Lu) with atomic number 71. The content of REM used herein refers to a total content of these elements.

[Formula (1) to Formula (5)]

The chemical composition of the steel material according to the present embodiment further satisfies Formula (1) to Formula (5):

$$0.140<C+0.194\times Si+0.065\times Mn+0.012\times Cr+0.033\times Mo+0.067\times Ni+0.097\times Cu+0.078\times Al<0.235 \quad (1)$$

$$1.35<(1.33\times C-0.1)+(0.23\times Si+0.01)+(0.42\times Mn+0.22)+(0.27\times Cr+0.22)+(0.77\times Mo+0.03)+(0.12\times Ni+0.01)<1.55 \quad (2)$$

$$0.004<Ti-N\times(48/14)<0.030 \quad (3)$$

$$0.03\leq Ca/S\leq 0.15 \quad (4)$$

$$Mn/(Si+Cr+Mo+Ni)<0.30 \quad (5)$$

where symbols of elements in Formula (1) to Formula (5) are to be substituted by contents of corresponding elements (in mass %). In a case where the corresponding element is an optional element and is not contained, the symbol of the element is substituted by "0". The formulae will be each described below.

[Formula (1)]

It is assumed that $F1=C+0.194\times Si+0.065\times Mn+0.012\times Cr+0.033\times Mo+0.067\times Ni+0.097\times Cu+0.078\times Al$. F1 is an index of hardness of the steel material and a carburized-steel component produced from this steel material.

If the content of C is low, a structure of the steel material before subjected to cold forging has a fraction of ferrite that is significantly increased as compared with that of the conventional steel material described above (its content of C is about 0.20%). In this case, hardness of the steel material is greatly influenced by not only the content of C (a fraction of pearlite) but also hardness of ferrite. F1 indicates contributions of the alloying elements to solid-solution strengthening on ferrite in the steel material.

If F1 is 0.235 or more, the hardness of the steel material before subjected to cold forging becomes too high. In this case, a critical working ratio of the steel material is decreased. On the other hand, if F1 is 0.140 or less, a core portion hardness necessary for a carburized-steel component becomes insufficient. Therefore, F1 is more than 0.140 to less than 0.235. F1 is preferably made as low as possible as long as a hardenability index (F2) described below falls within a range specified for F2. An upper limit of F1 is preferably less than 0.230, more preferably 0.225, still more preferably 0.220, even still more preferably 0.215, yet even still more preferably 0.210. Note that F1 is a value obtained by rounding off the resultant value to three decimal places.

[Formula (2)]

It is assumed that $F2=(1.33\times C-0.1)+(0.23\times Si+0.01)+(0.42\times Mn+0.22)+(0.27\times Cr+0.22)+(0.77\times Mo+0.03)+(0.12\times Ni+0.01)$. F2 is an index relating to hardenability of the steel material.

As described above, B is effective for increasing hardenability of a core portion of a carburized-steel component. However, in a case where gas carburizing is performed (in an endothermic gas system), the hardenability enhancing effect by contained B is minor in a carburized layer that is a surface layer portion of a carburized-steel component. This is because N in furnace atmospheric gas enters the surface layer portion of the carburized-steel component in carburizing treatment, which causes dissolved B to precipitate in a form of BN, causing shortage of an amount of dissolved B that contributes to enhancement of hardenability. For that reason, in a case where gas carburizing treatment is performed, B can increase hardness of a core portion of a carburized-steel component but is unlikely to contribute to enhancement of hardness of a carburized layer of the carburized-steel component. Therefore, in order to keep a hardenability in a carburized layer that is a surface layer portion of a carburized-steel component, it is necessary to use a hardenability enhancing element other than B.

F2 is constituted by elements other than B that particularly contribute to enhancement of hardenability. If F2 is 1.35 or less, it is not possible to obtain a sufficient depth of a carburized layer (a depth up to which a Vickers hardness is HV550 or more) that is equal to or more than that of the conventional steel material described above produced under the same carburizing treatment conditions (its content of C is about 0.20%). On the other hand, when F2 is 1.55 or more, hardness of a steel material before subjected to cold forging rises, decreasing a critical working ratio of the steel material. Therefore, F2 is more than 1.35 to less than 1.55. F2 is preferably made as high as possible as long as the hardness index F1 falls within the range specified for F1. A lower limit of F2 is preferably 1.36, more preferably 1.37, still more preferably 1.38, even still more preferably 1.40. Note that F2 is a value obtained by rounding off the resultant value to two decimal places.

[Formula (3)]

It is assumed that $F3=Ti-N\times(48/14)$. F3 is an index relating to a precipitation amount of TiC. When Ti is excessively contained relative to N stoichiometrically, all of N is immobilized in a form of TiN. In other words, F3 means a surplus amount of Ti, by which an amount of Ti consumed to form TiN is exceeded. In F3, "14" indicates an atomic weight of N, and "48" indicates an atomic weight of Ti.

Ti in the surplus amount defined by F3 mostly combines with C to form TiC in carburizing treatment. This TiC has the pinning effect of preventing or reducing coarsening of austenite grains in carburizing treatment. If F3 is 0.004 or less, the precipitation amount of TiC becomes insufficient. In this case, the coarsening of grains in carburizing treatment cannot be prevented or reduced. If grains become coarse grains, a deformation made by carburizing-quenching can be large due to decrease in bending fatigue strength or to an excessively high hardenability. On the other hand, when F3 is 0.030 or more, the precipitation amount of TiC becomes excessively large, which increases hardness of a steel material before subjected to cold forging rises, decreasing a critical working ratio of the steel material. Therefore, F3 is more than 0.004 to less than 0.030. A lower limit of F3 is preferably 0.006, more preferably 0.008. An upper limit of F3 is preferably 0.028, more preferably 0.0025. Note that F3 is a value obtained by rounding off the resultant value to three decimal places.

[Formula (4)]

It is assumed that $F4=Ca/S$. F4 is an index relating to refinement and spheroidization of sulfide. As described above, calcium is dissolved in sulfide, refining the sulfide and additionally spheroidizing the sulfide. However, even when the contents of the elements including Ca in the chemical composition of the steel material are within the respective ranges described above, if the content of Ca is excessively high relative to the content of S, part of Ca is not dissolved in sulfide but form oxide of Ca. The oxide of Ca decreases a critical working ratio of a steel material. When F4 (=Ca/S) can be set within an appropriate range, production of the oxide can be prevented or reduced while refinement and spheroidization of sulfide are accelerated. As a result, cold forgeability and a critical working ratio of a steel material can be increased.

If F4 is less than 0.03, the content of Ca is excessively low relative to the content of S in steel even when the contents of the elements in the chemical composition are within the respective ranges described above, F1 to F3 satisfy Formula (1) to Formula (3), and F5 satisfies Formula (5). In this case, refinement and spheroidization of sulfide become insufficient. As a result, a critical working ratio of a steel material is decreased. On the other hand, if F4 is more than 0.15, the content of Ca is excessively high relative to the content of S in steel even when the contents of the elements in the chemical composition are within the respective ranges described above, F1 to F3 satisfy Formula (1) to Formula (3), and F5 satisfies Formula (5). In this case, the oxide is produced excessively. As a result, a critical working ratio of a steel material is decreased. When the contents of the elements in the chemical composition are within the respective ranges according to the present embodiment, F1 to F3 satisfy Formula (1) to Formula (3), F5 satisfies Formula (5), and F4 is 0.03 to 0.15, sulfide can be refined and spheroidized sufficiently, and the excessive production of the oxide can be prevented or reduced. As a result, the critical working ratio in cold forging of the steel material is higher than that of a conventional steel material. A lower limit of F4 is preferably 0.04, more preferably 0.05, still more preferably 0.06. An upper limit of F4 is preferably 0.14, more preferably 0.13, still more preferably 0.12. Note that F4 is a value obtained by rounding off the resultant value to two decimal places.

[Formula (5)]

In addition to the limitation on the amount of Mn, satisfaction of Formula (5) enables the steel material according to the present embodiment to have an excellent hydrogen embrittlement resistance while the steel material has a high strength.

$$Mn/(Si+Cr+Mo+Ni)<0.30 \quad (5)$$

where a symbol of each element in Formula (5) is to be substituted by a content of the corresponding element (mass %).

It is assumed that F5=Mn/(Si+Cr+Mo+Ni). F5 has a correlation with hydrogen embrittlement resistance. This will be described below in detail.

FIG. 1 is a graph illustrating a relation between F5 and critical diffusible hydrogen amount ratio HR. In FIG. 1, its ordinate indicates the critical diffusible hydrogen amount ratio HR. The critical diffusible hydrogen amount ratio HR is a ratio with respect to a critical diffusible hydrogen amount Href of a steel material having a chemical composition equivalent to that of SCR420 in JIS G 4053(2016) and is defined by Formula (A) shown below.

$$\text{Critical diffusible hydrogen amount ratio } HR=Hc/Href \quad (A)$$

Hc denotes a critical diffusible hydrogen amount. The critical diffusible hydrogen amount Hc means a maximum hydrogen amount of hydrogen amounts of specimens that contain hydrogen introduced at various concentrations and are not ruptured in a constant load test performed on the specimens.

Referring to FIG. 1, as long as F5, which is a ratio of the content of Mn to a total content of Si, Cr, Mo, and Ni, is 0.30 or more, the critical diffusible hydrogen amount ratio HR does not become significantly high even if F5 is decreased. On the other hand, if F5 becomes less than 0.30, the critical diffusible hydrogen amount ratio prominently increases with decrease in F5, and the critical diffusible hydrogen amount ratio HR becomes 1.10 or more. In other words, the relation between F5 and the critical diffusible hydrogen amount ratio HR has an inflection point in a neighborhood of F5=0.30. Therefore, as long as F5 is less than 0.30, an excellent hydrogen embrittlement resistance is obtained. An upper limit of F5 is preferably 0.29, more preferably 0.28, still more preferably 0.27, even still more preferably 0.26. Note that there is no specific limitation on a lower limit of F5, the lower limit of F5 is 0.16 in a case of the chemical composition described above. The lower limit of F5 is preferably 0.18, more preferably 0.20, still more preferably 0.21.

[Microstructure of Steel Material]

In a microstructure of a steel material to be a starting material of a carburized-steel component, a portion other than inclusions and precipitates is defined as a parent phase (matrix). The matrix of the steel material is preferably made mainly of ferrite and pearlite. The phrase "made mainly of ferrite and pearlite" as used herein means that a total area fraction of ferrite and pearlite in the microstructure is 85.0 to 100.0%. In the matrix, phases other than ferrite and pearlite include, for example, bainite, martensite, and cementite. In other words, in the microstructure of the steel material according to the present embodiment, a total area fraction of bainite, martensite, and cementite is 0 to 15.0%. Note that when the total area fraction of ferrite and pearlite in the microstructure of the steel material according to the present embodiment is less than 100.0%, the balance is one or more types selected from the group consisting of bainite, martensite, and cementite. Note that, for calculation of the area fractions for the microstructure, ferrite, pearlite, martensite, bainite, and cementite are taken into account. At the same time, for the calculation of the area fractions, precipitates other than cementite, inclusions, and retained austenite are not taken into account.

[Method for Measuring Area Fraction of Ferrite and Pearlite]

The total area fraction (%) of ferrite and pearlite in the microstructure of the steel material according to the present embodiment is measured by the following method. In a case where the steel material is a steel bar or a wire rod, a sample is extracted from the steel material at a center position of a radius R connecting a surface of and a center of the steel material (R/2 position) on a cross section that is perpendicular to a longitudinal direction (axial direction) of the steel material (hereinafter, referred to as a "transverse section"). In a surface of the sample extracted, a surface corresponding to the transverse section is determined as an observation surface. The observation surface is subjected to mirror polish and then etched with 2% nitric acid and ethanol (Nital etching reagent). The etched observation surface is observed under an optical microscope with 500× magnification, and photographic images of any 20 visual fields on the etched observation surface are created. The visual fields are each set to have a size of 100 μm×100 μm.

In each visual field, phases such as ferrite and pearlite have their own contrasts different from each other. Therefore, the phases are identified based on their respective contrasts. Of the identified phases, a total area of ferrite ($\mu m^2$) and a total area of pearlite ($\mu m^2$) are determined in each visual field. A ratio of a sum of total areas of ferrite and total areas of pearlite in all the visual fields to a total area of all the visual fields is defined as the total area fraction (%) of ferrite and pearlite. Note that, for calculation of the area fractions for the microstructure, ferrite, pearlite, martensite (including tempered martensite), bainite (including tempered bainite), and cementite (including spheroidized cementite) are taken into account. At the same time, for the calculation of the area fractions, precipitates other than cementite, inclusions, and retained austenite are not taken into account. In a case where the observation surface is etched with the Nital etching reagent, phrases having lamella structures can be identified as pearlite in optical microscope observation. Zones having brightnesses higher than that of pearlite (while zones) can be identified as ferrite. Zones having brightnesses lower than that of ferrite and pearlite (dark zones) can be identified as martensite or bainite.

The steel material according to the present embodiment having the above-described configuration has a high critical working ratio. Moreover, when the steel material according to the present embodiment is subjected to cold forging, cutting, and carburizing treatment to be a carburized-steel component, the carburized-steel component has a high fatigue strength and an excellent hydrogen embrittlement resistance.

[Carburized-Steel Component]

The carburized-steel component according to the present embodiment is produced from the above-described steel material according to the present embodiment. Specifically, the carburized-steel component is produced by performing carburizing treatment on the steel material subjected to cold forging. A method for producing the carburized-steel component will be described below.

The carburized-steel component includes a carburized layer and a core portion. The carburized layer is formed in an outer layer of the carburized-steel component. A depth of the carburized layer from a surface of the carburized-steel component is 0.4 mm to less than 2.0 mm. In the carburized-steel component according to the present embodiment, the depth of the carburized layer is at least 0.4 mm or more. In the present embodiment, the carburized layer means a zone in the outer layer of the carburized-steel component where a Vickers hardness according to JIS Z 2244(2009) is 550 HV or more. The core portion corresponds to a zone inner than the carburized layer in the carburized-steel component. A chemical composition of the core portion is the same as the chemical composition of the above-described carburized-steel component. In other words, elements of the chemical composition of the core portion are within the respective numerical ranges described above and satisfy Formula (1) to Formula (5).

In the carburized-steel component, a 50 μm depth position from the surface of the carburized-steel component corresponds to the carburized layer. At the 50 μm depth position from the surface of the carburized-steel component, a Vickers hardness according to JIS Z 2244(2009) is 650 to 1000 HV. In other words, a Vickers hardness of the carburized layer at the above-described position is 650 to 1000 HV.

In the carburized-steel component having the above-described configuration, a 10.0 mm depth position from the surface of the carburized-steel component corresponds to the core portion. At the 10.0 mm depth position from the surface of the carburized-steel component, a Vickers hardness according to JIS Z 2244(2009) is 250 to 500 HV. In other words, a Vickers hardness of the core portion at the above-described position is 250 to 500 HV.

The carburized layer is formed by carburizing treatment, and the Vickers hardness of the carburized layer is higher than the Vickers hardness of the steel material being a starting material.

For the carburized-steel component, Vickers hardnesses are measured by the following method. A cross section of the carburized-steel component perpendicular to a given surface of the carburized-steel component is determined as a measurement surface. On the measurement surface, a Vickers hardness at a 50 μm depth position from the surface and a Vickers hardness at a 0.4 mm depth position from the surface are determined by the Vickers hardness test conforming to JIS Z 2244(2009) using a micro-Vickers durometer. A test force is set at 0.49 N. At the 50 μm depth position, Vickers hardnesses HV are measured at 10 spots. An arithmetic mean value of 10 measurement results is defined as a Vickers hardness HV at the 50 μm depth position. At the 0.4 mm depth position from the surface on the measurement surface, Vickers hardnesses HV are measured at 10 spots. An arithmetic mean value of 10 measurement results is defined as a Vickers hardness HV at the 0.4 mm depth position. When the Vickers hardness at the 0.4 mm depth position is 550 HV or more, it is determined that the depth of the carburized layer is at least 0.4 mm or more.

In addition, on the measurement surface, a Vickers hardness at a 10.0 mm depth position from the surface is determined by the Vickers hardness test conforming to JIS Z 2244(2009) using a Vickers durometer. A test force is set at 0.49 N. At the 10.0 mm depth position, Vickers hardnesses HV are measured at 10 spots. An arithmetic mean value of 10 measurement results is defined as a Vickers hardness HV at the 10.0 mm depth position.

The carburized-steel component is applied as, for example, a component for machine structural use that is to be used for a mining machinery, construction machinery, an automobile, or the like. Examples of the component for machine structural use include a gear, a shaft, and a pulley.

[Method for Producing Steel Material]

An example of a method for producing the steel material according to the present embodiment will be described. Note that the method for producing the steel material according to the present embodiment is not limited to the following producing method as long as the steel material according to the present embodiment has the configuration described above. Note that the producing method described below is a preferable example of producing the steel material according to the present embodiment.

The example of the method for producing the steel material according to the present embodiment includes a starting material preparation process and a hot working process. The steps will be each described below.

[Starting Material Preparation Process]

In the starting material preparation process, a starting material that has a chemical composition satisfying Formula (1) to Formula (5) described above is prepared. The starting material is produced by, for example, the following method. A molten steel that has a chemical composition satisfying Formula (1) to Formula (5) described above is produced. From the molten steel, the starting material (cast piece or ingot) is produced by a casting process. For example, from the molten steel, a cast piece (bloom) is produced by a well-known continuous casting process. Alternatively, from the molten steel, an ingot is produced through a well-known ingot-making process.

[Hot Working Process]

In the hot working process, the starting material (bloom or ingot) prepared by the starting material preparation step is subjected to hot working to be produced into a steel material. A shape of the steel material is not limited to a particular shape, but the steel material is, for example, a steel bar or a wire rod. In the following description, a case where the steel material is a steel bar will be described as an example. However, a steel material having a shape other than that of a steel bar can be produced by the same hot working step.

The hot working process includes a rough rolling step and a finish rolling step. In the rough rolling step, the starting material is subjected to hot working to be produced into a billet. In the rough rolling step, for example, a blooming mill is used. The blooming mill is used to perform blooming on the starting material, producing the billet. In a case where a continuous mill is placed downstream of the blooming mill, the billet produced by the blooming may be further subjected to hot rolling using the continuous mill to be produced into a smaller billet. In the continuous mill, horizontal stands each including a pair of horizontal rolls and vertical stands each including a pair of vertical rolls are arranged alternately in a row. By the steps described above, the starting material is produced into the billet through the rough rolling step. In the rough rolling step, a heating temperature in a reheating furnace is, for example, but not limited particularly to, 1100 to 1300° C.

In the finish rolling step, first, the billet is heated in a reheating furnace. The heated billet is subjected to hot rolling using a continuous mill to be produced into a steel bar being the steel material. In the finish rolling step, a heating temperature in the reheating furnace is, for example, but not limited particularly to, 1000 to 1250° C. In the finish rolling, a temperature of the steel material at a delivery side of a roll stand with which final rolling is performed is defined as a finishing temperature. At the time, the finishing temperature is, for example, 800 to 1000° C. The finishing temperature is measured with a thermometer that is installed at a delivery side of the roll stand with which the final rolling is performed.

The steel material subjected to the finish rolling is cooled at a cooling rate not more than that of allowing cooling to be produced into the steel material according to the present embodiment. For the steel material subjected to the finish rolling, it is preferable to set an average cooling rate CR at more than 0 to 1.3° C./sec for a temperature range where the temperature of the steel material is 800° C. to 500° C. Where the temperature of the steel material is 800 to 500° C., phase transformation of austenite to ferrite or pearlite occurs. When the average cooling rate CR is more than 0 to 1.3° C./sec for the temperature range where the temperature of the steel material is 800° C. to 500° C., excessive production of bainite or martensite in the microstructure can be prevented or reduced, so that the total area fraction of ferrite and pearlite in the microstructure becomes 85.0 to 100.0%.

The average cooling rate CR is measured by the following method. The steel material subjected to the finish rolling is conveyed downstream on a conveyance line. Along the conveyance line, a plurality of thermometers are disposed, with which the temperature of the steel material can be measured at positions of the conveyance line. Based on measurement results from the plurality of thermometers disposed along the conveyance line, a time taken by the temperature of the steel material to fall from 800° C. to 500° C. is determined, and thereby the average cooling rate CR (° C./sec) is determined. The average cooling rate CR can be adjusted by, for example, disposing a plurality of slow cooling covers spaced at intervals along the conveyance line.

Through these producing processes, the steel material having the configuration described above according to the present embodiment can be produced.

[Method for Producing Carburized-Steel Component]

Next, an example of a method for producing a carburized-steel component for which the steel material according to the present embodiment is used as a starting material will be described. This producing method includes a cold forging process of performing cold forging on the steel material according to the present embodiment to produce an intermediate member, a cutting process of cutting the intermediate member, a carburizing treatment process of performing carburizing treatment on the intermediate member, and a tempering process. Note that, in the present embodiment, the carburizing treatment includes carbonitriding treatment as described above.

[Cold Forging Process]

In the cold forging process, cold forging is performed as cold working on the steel material produced by the producing method described above to give a shape to the steel material, producing the intermediate member. In the cold forging process, its plastic deformation conditions including a working ratio, a strain rate, and the like are not limited to particular conditions, and suitable conditions may be selected as appropriate.

[Cutting Process]

The cutting process is performed when necessary. In other words, the cutting process may not be performed. When the cutting process is performed, cutting is performed on the intermediate member that has undergone the cold forging step and has not undergone the carburizing treatment process to be described below. By performing cutting, the carburized-steel component can be given a near net shape that is difficult to give only by the cold forging process.

[Carburizing Treatment Process]

In the carburizing treatment process, carburizing treatment is performed on the intermediate member that has undergone the cutting process. Here, in the present embodiment, the carburizing treatment includes carbonitriding treatment. In the carburizing treatment process, a well-known carburizing treatment is performed. The carburizing treatment process includes a carburizing step, a diffusing step, and a quenching step.

Carburizing treatment conditions for the carburizing step and the diffusing step are adjusted as appropriate. In the carburizing step and the diffusing step, their carburizing temperatures are, for example, 830 to 1100° C. In the carburizing step and the diffusing step, their carbon potentials are, for example, 0.5 to 1.2%. In the carburizing step, its retention time is 60 minutes or more, and in the diffusing step, its retention time is 30 minutes or more. The carbon potential of the diffusing step is preferably made lower than the carbon potential of the carburizing step. However, conditions for the carburizing step and the diffusing step are not limited to the conditions described above.

After the diffusing step, a well-known quenching step is performed. In the quenching step, the intermediate member that has undergone the diffusing step is retained at a quenching temperature being not less than the Ar3 transformation point. A time of retention at the quenching temperature is, for example, but not limited particularly to, 30 to 60 minutes. The quenching temperature is preferably lower than the carburizing temperature. A temperature of a quenching medium is preferably set at room temperature to 200° C. The quenching medium is, for example, water or oil. After the quenching, sub-zero treatment may be performed as needed.

[Tempering Process]

A well-known tempering process is performed on the intermediate member that has undergone the carburizing treatment process. A tempering temperature is, for example, 100 to 200° C. A time of retention at the tempering temperature is, for example, 90 to 150 minutes.

[Additional Processes]

When necessary, the carburized-steel component that has undergone the tempering step may be subjected to grinding or shotpeening treatment. By performing grinding, the carburized-steel component can be given a near net shape. By performing shotpeening treatment, compressive residual stress is introduced to a surface layer portion of the carburized-steel component. Compressive residual stress prevents or reduces occurrence or propagation of a fatigue crack. Shotpeening treatment therefore increases fatigue strength of a carburized-steel component. For example, in a case where the carburized-steel component is a gear, fatigue strengths of tooth fillets and tooth flanks of the carburized-steel component can be enhanced. The shotpeening treatment is performed by a well-known method. The shotpeening treatment is preferably performed under such conditions including, for example, use of shot media having diameters of 0.7 mm or less and an arc height of 0.4 mm or more.

Examples

Advantageous effects of an aspect of the present invention will be described more specifically through Examples. Conditions of Examples described below are an example of conditions that are adapted to confirm feasibility and advantageous effects of the steel material for a carburized-steel component according to the present embodiment. Therefore, the present invention is not limited to this example of conditions. For the present invention, various conditions can be adapted as long as the conditions achieve the objective of the present invention without departing from the gist of the present invention.

Molten steels having chemical compositions shown in Table 1 were prepared.

TABLE 1

| Test | Chemical composition (in mass %, balance being Fe and impurities) | | | | | | | | | | | | | | | | | | | | | | | | |
|---|---|---|---|---|---|---|---|---|---|---|---|---|---|---|---|---|---|---|---|---|---|---|---|---|---|
| No. | C | Si | Mn | S | Cr | B | Ti | Al | Ca | N | P | O | Nb | V | Mo | Ni | Cu | Mg | REM | F1 | F2 | F3 | F4 | F5 | Remarks |
| 1 | 0.11 | 0.25 | 0.60 | 0.011 | 1.95 | 0.0025 | 0.040 | 0.030 | 0.0010 | 0.0065 | 0.005 | 0.0020 | | | | | | | | 0.223 | 1.37 | 0.018 | 0.09 | 0.27 | Inventive Example |
| 2 | 0.07 | 0.15 | 0.65 | 0.014 | 2.10 | 0.0024 | 0.035 | 0.015 | 0.0015 | 0.0080 | 0.008 | 0.0025 | | | | | | | | 0.168 | 1.36 | 0.008 | 0.11 | 0.29 | Inventive Example |
| 3 | 0.13 | 0.19 | 0.64 | 0.012 | 2.00 | 0.0025 | 0.025 | 0.021 | 0.0004 | 0.0058 | 0.011 | 0.0025 | 0.008 | | | | | | | 0.234 | 1.42 | 0.005 | 0.03 | 0.29 | Inventive Example |
| 4 | 0.13 | 0.15 | 0.60 | 0.019 | 1.92 | 0.0020 | 0.030 | 0.025 | 0.0025 | 0.0065 | 0.010 | 0.0020 | | | | | | | | 0.223 | 1.37 | 0.008 | 0.13 | 0.29 | Inventive Example |
| 5 | 0.11 | 0.18 | 0.73 | 0.015 | 2.15 | 0.0024 | 0.036 | 0.032 | 0.0008 | 0.0065 | 0.005 | 0.0015 | | | 0.080 | 0.070 | | | | 0.228 | 1.53 | 0.014 | 0.05 | 0.29 | Inventive Example |
| 6 | 0.11 | 0.17 | 0.60 | 0.013 | 2.34 | 0.0025 | 0.021 | 0.015 | 0.0004 | 0.0045 | 0.006 | 0.0020 | 0.050 | | | | | | | 0.211 | 1.46 | 0.006 | 0.03 | 0.24 | Inventive Example |
| 7 | 0.13 | 0.19 | 0.60 | 0.014 | 2.10 | 0.0024 | 0.049 | 0.020 | 0.0010 | 0.0060 | 0.098 | 0.0020 | | | | | 0.010 | | | 0.234 | 1.43 | 0.028 | 0.07 | 0.26 | Inventive Example |
| 8 | 0.12 | 0.21 | 0.60 | 0.016 | 2.15 | 0.0025 | 0.025 | 0.035 | 0.0005 | 0.0041 | 0.001 | 0.0025 | | | | | | | | 0.228 | 1.43 | 0.011 | 0.03 | 0.25 | Inventive Example |
| 9 | 0.13 | 0.17 | 0.60 | 0.014 | 2.34 | 0.0024 | 0.035 | 0.018 | 0.0020 | 0.0050 | 0.005 | 0.0025 | | | | | | | | 0.231 | 1.49 | 0.018 | 0.14 | 0.24 | Inventive Example |
| 10 | 0.07 | 0.32 | 0.63 | 0.011 | 1.95 | 0.0025 | 0.036 | 0.025 | 0.0015 | 0.0040 | 0.008 | 0.0030 | | | 0.010 | 0.010 | | | | 0.199 | 1.36 | 0.022 | 0.14 | 0.28 | Inventive Example |
| 11 | 0.11 | 0.16 | 0.60 | 0.011 | 2.49 | 0.0024 | 0.035 | 0.028 | 0.0005 | 0.0054 | 0.008 | 0.0025 | | | 0.050 | 0.050 | 0.050 | | | 0.222 | 1.54 | 0.016 | 0.05 | 0.22 | Inventive Example |
| 12 | 0.13 | 0.24 | 0.64 | 0.014 | 2.23 | 0.0024 | 0.045 | 0.032 | 0.0010 | 0.0060 | 0.011 | 0.0025 | | | | | | | | 0.247 | 1.49 | 0.024 | 0.07 | 0.26 | Comparative Example |
| 13 | 0.05 | 0.32 | 0.79 | 0.011 | 2.48 | 0.0025 | 0.025 | 0.012 | 0.0015 | 0.0041 | 0.008 | 0.0030 | 0.010 | | | 0.100 | 0.200 | | | 0.220 | 1.54 | 0.011 | 0.14 | 0.27 | Comparative Example |
| 14 | 0.16 | 0.17 | 0.64 | 0.016 | 2.15 | 0.0024 | 0.048 | 0.011 | 0.0005 | 0.0058 | 0.008 | 0.0025 | | | | | | | | 0.261 | 1.49 | 0.028 | 0.03 | 0.28 | Comparative Example |
| 15 | 0.11 | 0.15 | 0.60 | 0.006 | 1.92 | 0.0025 | 0.034 | 0.015 | 0.0003 | 0.0065 | 0.006 | 0.0020 | | | | | | | | 0.202 | 1.34 | 0.012 | 0.05 | 0.29 | Comparative Example |
| 16 | 0.11 | 0.16 | 0.65 | 0.015 | 2.46 | 0.0024 | 0.048 | 0.020 | 0.0010 | 0.0060 | 0.008 | 0.0020 | | | 0.080 | 0.010 | | | | 0.217 | 1.57 | 0.027 | 0.07 | 0.24 | Comparative Example |
| 17 | 0.12 | 0.19 | 0.62 | 0.015 | 2.13 | 0.0024 | 0.021 | 0.025 | 0.0015 | 0.0056 | 0.001 | 0.0025 | | | 0.050 | | | | | 0.226 | 1.47 | 0.002 | 0.10 | 0.26 | Comparative Example |
| 18 | 0.12 | 0.21 | 0.65 | 0.007 | 1.98 | 0.0025 | 0.048 | 0.020 | 0.0004 | 0.0024 | 0.008 | 0.0025 | | | 0.050 | 0.020 | | | | 0.231 | 1.45 | 0.040 | 0.06 | 0.29 | Comparative Example |
| 19 | 0.11 | 0.17 | 0.66 | 0.015 | 2.31 | 0.0024 | 0.048 | 0.020 | 0.0002 | 0.0058 | 0.008 | 0.0025 | 0.050 | | | | | | | 0.215 | 1.48 | 0.028 | 0.01 | 0.27 | Comparative Example |
| 20 | 0.13 | 0.19 | 0.61 | 0.013 | 2.01 | 0.0025 | 0.025 | 0.035 | 0.0021 | 0.0041 | 0.010 | 0.0030 | | | | | | | | 0.233 | 1.41 | 0.011 | 0.16 | 0.28 | Comparative Example |
| 21 | 0.09 | 0.21 | 0.74 | 0.006 | 2.47 | 0.0025 | 0.056 | 0.015 | 0.0003 | 0.0065 | 0.006 | 0.0020 | | | 0.100 | | | | | 0.213 | 1.61 | 0.034 | 0.05 | 0.27 | Comparative Example |
| 22 | 0.09 | 0.19 | 0.72 | 0.045 | 2.30 | 0.0024 | 0.035 | 0.020 | 0.0050 | 0.0060 | 0.008 | 0.0020 | | | | | | | | 0.203 | 1.48 | 0.014 | 0.11 | 0.29 | Comparative Example |
| 23 | 0.11 | 0.17 | 0.61 | 0.014 | 1.94 | 0.0025 | 0.034 | 0.015 | | 0.0065 | 0.001 | 0.0020 | 0.050 | | | | | | | 0.207 | 1.36 | 0.012 | 0.00 | 0.29 | Comparative Example |
| 24 | 0.13 | 0.05 | 0.61 | 0.013 | 2.14 | 0.0025 | 0.025 | 0.035 | 0.0015 | 0.0041 | 0.010 | 0.0030 | | | | | | | | 0.208 | 1.41 | 0.011 | 0.12 | 0.28 | Comparative Example |
| 25 | 0.11 | 0.17 | 0.61 | 0.001 | 1.94 | 0.0025 | 0.034 | 0.015 | | 0.0065 | 0.001 | 0.0020 | 0.050 | | | | | | | 0.207 | 1.36 | 0.012 | 0.00 | 0.29 | Comparative Example |
| 26 | 0.10 | 0.18 | 0.76 | 0.014 | 1.99 | 0.0025 | 0.022 | 0.026 | 0.0007 | 0.0045 | 0.009 | 0.0025 | | | 0.010 | 0.030 | | | | 0.213 | 1.43 | 0.007 | 0.05 | 0.34 | Comparative Example |
| 27 | 0.07 | 0.15 | 0.20 | 0.018 | 1.95 | 0.0032 | 0.035 | 0.018 | 0.0020 | 0.0054 | 0.005 | 0.0030 | | | | | | | | 0.137 | 1.13 | 0.016 | 0.11 | 0.10 | Comparative Example |
| 28 | 0.07 | 0.34 | 0.61 | 0.013 | 2.49 | 0.0025 | 0.022 | 0.016 | 0.0005 | 0.0045 | 0.006 | 0.0030 | | | 0.010 | 0.300 | | | | 0.227 | 1.53 | 0.006 | 0.04 | 0.19 | Inventive Example |
| 29 | 0.22 | 0.25 | 0.71 | 0.014 | 1.21 | | | 0.036 | | 0.0014 | 0.004 | 0.0040 | | | | | | | | 0.332 | 1.37 | −0.005 | 0.00 | 0.49 | Reference Example |
| 30 | 0.13 | 0.17 | 0.61 | 0.019 | 2.11 | 0.0031 | 0.031 | 0.035 | 0.0021 | 0.0065 | 0.012 | 0.0020 | | 0.060 | | | | | | 0.231 | 1.43 | 0.009 | 0.11 | 0.27 | Inventive Example |
| 31 | 0.12 | 0.18 | 0.67 | 0.016 | 2.14 | 0.0024 | 0.025 | 0.032 | 0.0010 | 0.0058 | 0.008 | 0.0025 | | | | | | 0.001 | | 0.227 | 1.45 | 0.005 | 0.06 | 0.29 | Inventive Example |
| 32 | 0.10 | 0.25 | 0.75 | 0.011 | 2.34 | 0.0025 | 0.040 | 0.030 | 0.0014 | 0.0065 | 0.005 | 0.0020 | | | | | | | 0.001 | 0.228 | 1.53 | 0.018 | 0.13 | 0.29 | Inventive Example |
| 33 | 0.18 | 0.20 | 0.65 | 0.015 | 0.95 | | | 0.035 | | 0.0135 | 0.005 | 0.0015 | | | 0.210 | | | | | 0.281 | 1.37 | −0.046 | 0.00 | 0.48 | Reference Example |
| 34 | 0.11 | 0.21 | 0.72 | 0.012 | 2.48 | 0.0023 | 0.035 | 0.031 | 0.0006 | 0.0064 | 0.008 | 0.0025 | | | | | | | | 0.230 | 1.56 | 0.013 | 0.05 | 0.247 | Comparative Example |
| 35 | 0.10 | 0.25 | 0.68 | 0.015 | 2.15 | 0.0024 | 0.029 | 0.035 | 0.0008 | 0.0075 | 0.005 | 0.0025 | | | | | | | | 0.221 | 1.45 | 0.003 | 0.05 | 0.28 | Comparative Example |
| 36 | 0.08 | 0.34 | 0.71 | 0.006 | 2.10 | 0.0025 | 0.048 | 0.015 | 0.0003 | 0.0035 | 0.006 | 0.0020 | | | | | | | | 0.218 | 1.44 | 0.036 | 0.05 | 0.29 | Comparative Example |
| 37 | 0.09 | 0.32 | 0.74 | 0.017 | 2.31 | 0.0024 | 0.048 | 0.020 | 0.004 | 0.0068 | 0.010 | 0.0035 | | | | | | | | 0.229 | 1.52 | 0.025 | 0.02 | 0.28 | Comparative Example |
| 38 | 0.11 | 0.19 | 0.75 | 0.015 | 2.15 | 0.0024 | 0.036 | 0.032 | 0.0008 | 0.0065 | 0.005 | 0.0015 | | | | | | | | 0.224 | 1.48 | 0.014 | 0.05 | 0.32 | Comparative Example |
| 39 | 0.12 | 0.15 | 0.79 | 0.014 | 1.91 | 0.0024 | 0.034 | 0.015 | 0.0020 | 0.0041 | 0.001 | 0.0025 | | | | | | | | 0.225 | 1.43 | 0.020 | 0.14 | 0.38 | Comparative Example |

In Table 1, blank cells each mean that a content of a corresponding element is less than a detection limit of the element. In other words, the blank cells each mean that a content of a corresponding element is less than a detection limit at its least significant digit. For example, in a case of a content of Ti in Table 1, its least significant digit is the third decimal place. Therefore, a content of Ti of Test No. 29 means that Ti was not detected up to the third decimal place (the content of Ti was 0% through significant figures up to the third decimal place).

From the molten steels, cast pieces were produced by the continuous casting process. These cast pieces were heated and then subjected to blooming as the rough rolling step and then to rolling with the continuous mill to be produced into billets each having a 162 mm×162 mm cross section perpendicular to a longitudinal direction. A heating temperature of the blooming was 1200 to 1250° C.

The produced billets were subjected to the finish rolling step to be produced into steel bars (steel materials to be starting materials of carburized-steel components) each having a diameter of 80 mm. For each test number, its heating temperature T1 in a reheating furnace in the finish rolling step was as shown in Table 2. For all test numbers, their times of retention in the reheating furnace were 1.5 to 3.0 hours. For each test number, its finishing temperature T2 and its average cooling rate CR for a range where temperatures of steel materials were 800 to 500° C. were as shown in Table 2. Through the producing steps described above, a steel material (steel bar) of each test number was produced.

TABLE 2

| | | | | | | Carburized-steel component (as slow cooled) | | | | | | | |
|---|---|---|---|---|---|---|---|---|---|---|---|---|---|
| | | | | | | Carburized layer | | Core portion | | | | | |
| | Finish rolling step | | | Total area fraction | | Hardness at 50 μm depth position (HV) | Hardness at 0.4 mm depth position (HV) | Hardness at 10 mm depth position (HV) | Chemical composition at 10 mm depth position | | | | |
| Test No. | Heating temperature T1 (° C.) | Finishing temperature T2 (° C.) | Average cooling rate CR (° C./sec) | of ferrite and pearlite (%) | Critical compression ratio (%) | | | | | Occurrence of coarse grain in carburizing | Fatigue strength ratio | HR = Hc/Href | Remarks |
| 1 | 1030 | 820 | 1.0 | 94 | 72 | 795 | 741 | 295 | Same | Not produced | 130 | 1.20 | Inventive Example |
| 2 | 1030 | 830 | 1.2 | 99 | 74 | 815 | 754 | 305 | Same | Not produced | 120 | 1.20 | Inventive Example |
| 3 | 1040 | 840 | 1.2 | 94 | 70 | 812 | 732 | 312 | Same | Not produced | 125 | 1.20 | Inventive Example |
| 4 | 1100 | 835 | 0.8 | 95 | 71 | 813 | 757 | 340 | Same | Not produced | 120 | 1.20 | Inventive Example |
| 5 | 1030 | 845 | 0.9 | 94 | 70 | 925 | 784 | 324 | Same | Not produced | 125 | 1.10 | Inventive Example |
| 6 | 1040 | 840 | 1.1 | 95 | 73 | 823 | 736 | 301 | Same | Not produced | 125 | 1.30 | Inventive Example |
| 7 | 1150 | 830 | 1.0 | 93 | 71 | 842 | 725 | 310 | Same | Not produced | 125 | 1.30 | Inventive Example |
| 8 | 1200 | 835 | 1.2 | 90 | 71 | 812 | 741 | 301 | Same | Not produced | 130 | 1.20 | Inventive Example |
| 9 | 1040 | 840 | 1.0 | 94 | 69 | 831 | 768 | 268 | Same | Not produced | 120 | 1.25 | Inventive Example |
| 10 | 1030 | 835 | 1.1 | 97 | 73 | 813 | 745 | 298 | Same | Not produced | 130 | 1.15 | Inventive Example |
| 11 | 1035 | 840 | 1.1 | 95 | 70 | 801 | 732 | 335 | Same | Not produced | 120 | 1.30 | Inventive Example |
| 12 | 1050 | 840 | 1.2 | 93 | 63 | — | — | — | — | — | — | 1.20 | Comparative Example |
| 13 | 1150 | 835 | 1.0 | 96 | 70 | 821 | 741 | 221 | Same | Not produced | 130 | 1.25 | Comparative Example |
| 14 | 1030 | 840 | 1.0 | 92 | 65 | — | — | — | — | — | — | 1.20 | Comparative Example |
| 15 | 1040 | 835 | 0.8 | 96 | 70 | 801 | 753 | 230 | Same | Not produced | 120 | 1.15 | Comparative Example |
| 16 | 1040 | 840 | 1.2 | 95 | 63 | — | — | — | — | — | — | 1.30 | Comparative Example |
| 17 | 1150 | 835 | 0.9 | 94 | 71 | 798 | 712 | 351 | Same | Produced | 120 | 1.30 | Comparative Example |
| 18 | 1050 | 960 | 0.9 | 94 | 64 | — | — | — | — | — | — | 1.10 | Comparative Example |
| 19 | 1035 | 840 | 1.2 | 95 | 62 | — | — | — | — | — | — | 1.25 | Comparative Example |
| 20 | 1050 | 835 | 1.0 | 94 | 59 | — | — | — | — | — | — | 1.30 | Comparative Example |
| 21 | 1150 | 835 | 0.9 | 95 | 61 | — | — | — | — | — | — | 1.20 | Comparative Example |
| 22 | 1030 | 830 | 1.2 | 96 | 65 | — | — | — | — | — | — | 1.20 | Comparative Example |
| 23 | 1050 | 840 | 1.0 | 94 | 61 | — | — | — | — | — | — | 1.20 | Comparative Example |

TABLE 2-continued

| | Finish rolling step | | | Total area fraction | | Carburized-steel component (as slow cooled) | | | | | | | |
|---|---|---|---|---|---|---|---|---|---|---|---|---|---|
| | | | | | | Carburized layer | | Core portion | | | | | |
| Test No. | Heating temperature T1 (° C.) | Finishing temperature T2 (° C.) | Average cooling rate CR (° C./sec) | of ferrite and pearlite (%) | Critical compression ratio (%) | Hardness at 50 μm depth position (HV) | Hardness at 0.4 mm depth position (HV) | Hardness at 10 mm depth position (HV) | Chemical composition at 10 mm depth position | Occurrence of coarse grain in carburizing | Fatigue strength ratio | HR = Hc/Href | Remarks |
| 24 | 1020 | 845 | 0.8 | 95 | 73 | 812 | 781 | 369 | — | Not produced | 95 | 1.30 | Comparative Example |
| 25 | 1040 | 860 | 1.1 | 96 | 65 | — | — | — | — | — | — | 1.20 | Comparative Example |
| 26 | 1055 | 850 | 0.8 | 95 | 72 | 855 | 743 | 349 | Same | Not produced | 120 | 1.05 | Comparative Example |
| 27 | 1030 | 855 | 0.8 | 100 | 75 | 865 | 732 | 241 | Same | Not produced | 90 | 1.30 | Comparative Example |
| 28 | 1050 | 845 | 0.9 | 94 | 71 | 840 | 740 | 386 | Same | Not produced | 120 | 1.30 | Inventive Example |
| 29 | 1140 | 850 | 1.0 | 87 | 60 | 845 | 731 | 305 | Same | Not produced | 100 | 1.00 | Reference Example |
| 30 | 1035 | 850 | 1.1 | 94 | 71 | 856 | 785 | 321 | Same | Not produced | 130 | 1.20 | Inventive Example |
| 31 | 1040 | 835 | 1.0 | 95 | 72 | 836 | 796 | 314 | Same | Not produced | 125 | 1.25 | Inventive Example |
| 32 | 1055 | 840 | 0.9 | 96 | 75 | 874 | 742 | 332 | Same | Not produced | 130 | 1.25 | Inventive Example |
| 33 | 1030 | 850 | 0.9 | 92 | 55 | 798 | 721 | 331 | Same | Not produced | 115 | 1.00 | Reference Example |
| 34 | 1025 | 855 | 0.9 | 94 | 61 | 878 | 776 | 319 | Same | Not produced | 125 | 1.20 | Comparative Example |
| 35 | 1050 | 840 | 1.0 | 95 | 71 | 798 | 712 | 305 | Same | Produced | 125 | 1.20 | Comparative Example |
| 36 | 1060 | 825 | 0.9 | 95 | 65 | — | — | — | — | — | — | 1.10 | Comparative Example |
| 37 | 1040 | 855 | 1.1 | 94 | 63 | — | — | — | — | — | — | 1.10 | Comparative Example |
| 38 | 1150 | 840 | 0.9 | 96 | 73 | 840 | 736 | 306 | Same | Not produced | 120 | 1.05 | Comparative Example |
| 39 | 1030 | 835 | 1.2 | 94 | 71 | 846 | 741 | 317 | Same | Not produced | 120 | 1.00 | Comparative Example |

[Evaluation Test]

[Microstructure Observation Test]

A sample for microstructure observation was extracted from the steel bar of each test number at its R/2 position. Of surfaces of the sample, a surface equivalent to a cross section perpendicular to a longitudinal direction of the steel bar was determined as an observation surface. The observation surface was subjected to mirror polish and then etched with 2% nitric acid and ethanol (Nital etching reagent). The etched observation surface was observed under an optical microscope with 500× magnification, and photographic images of any 20 visual fields on the etched observation surface were created. The visual fields were each set to have a size of 100 μm×100 μm. Phases such as ferrite and pearlite have their own contrasts different from each other. Therefore, the phases were identified based on their respective contrasts. Of the identified phases, a total area of ferrite ($\mu m^2$) and a total area of pearlite ($\mu m^2$) were determined in each visual field. A ratio of a sum of total areas of ferrite and total areas of pearlite in all the visual fields to a total area of all the visual fields was defined as the total area fraction (%) of ferrite and pearlite. As a result of measurement, every test number showed that its total area fraction of ferrite and pearlite was 85.0% or more.

[Critical Compression Test]

As an evaluation test for cold forgeabilities of the steel materials (critical working ratios), a critical compression test was conducted. Specifically, from the steel material (steel bar) of each test number, a plurality of test specimens for critical-compression-ratio measurement were extracted. The test specimens for critical-compression-ratio measurement each had a diameter of 6 mm and a length of 9 mm. A longitudinal direction of the test specimens for critical-compression-ratio measurement was parallel to the longitudinal direction of the steel bar of each test number. A central axis of each specimen corresponded to the R/2 position of the steel bar of each test number. At a center position in the longitudinal direction of the specimen, a notch was formed in a circumferential direction. The notch had a notch angle of 30 degrees and a notch depth of 0.8 mm, and a radius of curvature of a tip of the notch was 0.15 mm.

For the critical compression test, a 500-ton oil hydraulic press was used. The fabricated test specimens for critical-compression-ratio measurement were subjected to the critical compression test by the following method. The test specimens were each subjected to cold compression using restraint dies at a speed of 10 mm/min. The compression was stopped when a 0.5 mm or more minute crack occurred in a vicinity of the notch, and a compression ratio (%) at the time was calculated. This measurement was performed 10 times in total, and a compression ratio (%) at which a cumulative percent failure reaches 50% was determined. The determined compression ratio was defined as the critical compression ratio (%). The critical compression ratio (%) of each test number is shown in Table 2. A critical compression ratio of a conventional steel material to be a starting material of a carburized-steel component is about 65%. Hence, a case where the critical compression ratio is 68% or more, which is considered to be obviously higher than the above value was determined to be excellent in critical working ratio. For a test number of which the critical compression ratio is less than 68%, a carburized-steel component of which a starting material is its steel material was not subjected to the evaluation test and a fatigue test.

[Evaluation Test on Carburized-Steel Component]

Figure 2:
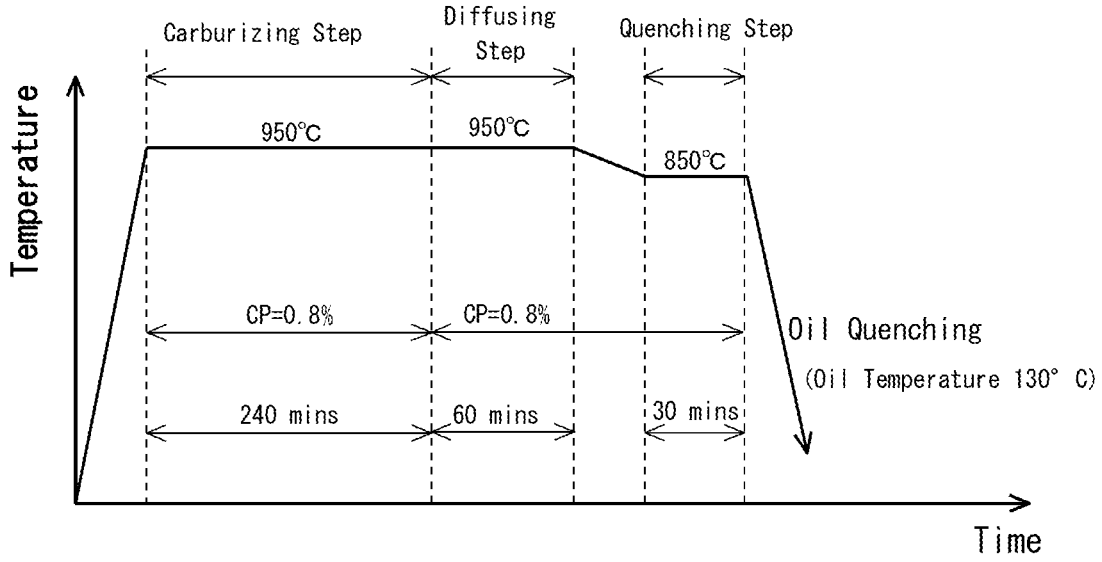
FIG. 2 is a heating pattern chart of carburizing treatment in an evaluation test on a carburized-steel component performed in Examples.

From the steel material (steel bar) of each test number, a carburized-steel component was produced by the following method. From the steel bar of each test number, a test specimen having a diameter of 26 mm and a length of 150 mm was extracted. A center of the test specimen substantially matched a center of the steel bar of each test number. The extracted test specimen was subjected to carburizing treatment of the endothermic gas system (gas carburizing treatment). As illustrated in FIG. 2, in the gas carburizing treatment, the test specimen was retained at 950° C. for 5 hours (the carburizing step was performed at 950° C. for 240 minutes, and the diffusing step was performed at 950° C. for 60 minutes), with the carbon potential set at 0.8%. Subsequently, the test specimen was retained at a quenching temperature of 850° C. for 30 minutes. After these steps, the test specimen was immersed in an oil bath at 130° C. to be subjected to oil quenching. The test specimen subjected to the quenching was tempered at 150° C. for 90 minutes to be produced into the carburized-steel component.

The following measurement was performed on a carburized layer and a core portion of the carburized-steel component of each test number. Specifically, on a section of the carburized-steel component of each test number perpendicular to a longitudinal direction of the carburized-steel component, a Vickers hardness at the 50 μm depth position from a surface of the carburized-steel component and a Vickers hardness at the 0.4 mm depth position from the surface are determined by the Vickers hardness test conforming to JIS Z 2244(2009) using a micro-Vickers durometer. A test force was set at 0.49 N. At the 50 μm depth position, Vickers hardnesses HV were measured at 10 spots, and an arithmetic mean value of the Vickers hardnesses HV was determined as the Vickers hardness HV at the 50 μm depth position. At the 0.4 mm depth position, Vickers hardnesses HV were measured at 10 spots, and an arithmetic mean value of the Vickers hardnesses HV was determined as the Vickers hardness HV at the 0.4 mm depth position.

When the Vickers hardness at the 0.4 mm depth position from the surface is 550 HV or more, it was determined that the carburized layer extended to at least 0.4 mm from the surface. In a case where the Vickers hardness at the 50 μm depth position from the surface was 650 to 1000 HV, it was determined that the carburized layer of the carburized-steel component had a sufficient hardness. Results of the measurement are shown in Table 2.

A Vickers hardness and a chemical composition of a core portion of the carburized-steel component described above were measured by the following method. On a section of the carburized-steel component perpendicular to the longitudinal direction, a Vickers hardness at the 10.0 mm depth position from the surface of the carburized-steel component was determined by the Vickers hardness test conforming to JIS Z 2244(2009) using a Vickers durometer. A test force was set at 0.49 N. At the 10.0 mm depth position, Vickers hardnesses HV were measured at 10 times, and a mean value of the Vickers hardnesses HV was determined as the Vickers hardness (HV) at the 10.0 mm depth position from the surface. The resultant Vickers hardnesses are shown in Table 2. In a case where the Vickers hardness at the 10.0 mm depth position was 250 to 500 HV, it was determined that a hardness of the core portion was sufficiently high.

A chemical composition at the 10.0 mm depth position from the surface was measured by performing quantitative analysis for elements of which atomic numbers are 5 or more using an electron probe micro analyzer (EPMA). A case where the chemical composition is the same as the chemical composition of chemical components of the steel material, it is determined that the chemical composition of the core portion of the carburized-steel component is the same as the chemical composition of the steel material. Results of the determination are shown in Table 2.

[Checking for Coarse Grains in Carburized-Steel Component]

In the core portion of the carburized-steel component described above, observation of prior-austenite grains was conducted at the 10.0 mm depth position from the surface. Specifically, a section of the carburized-steel component perpendicular to the longitudinal direction was determined as an observation surface. The observation surface was subjected to mirror polish and then etched in picric acid saturated aqueous solution. On the etched observation surface, a visual field (300 μm×300 μm) including the 10.0 mm depth position from the surface of the carburized-steel component was observed under an optical microscope (400×), and prior-austenite grains were identified. For each of the identified prior-austenite grains, a grain diameter was determined in circle equivalent diameter (μm) in conformity with JIS G 0551(2013). In a case where any one of the prior-austenite grains is a grain having a circle equivalent diameter that is more than a circle equivalent diameter corresponding to a grain size number of 4 according to the JIS definition described above (88.4 μm), it is determined that "a coarse grain was produced".

[Roller-Pitting Fatigue Strength Test]

Figure 3:
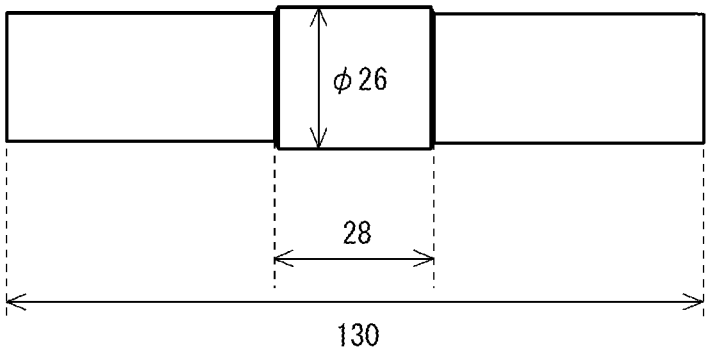
FIG. 3 is a side view of a small roller specimen used in a roller-pitting test in Examples.

The steel bar having a diameter of 80 mm of each test number was machined to be fabricated into a roller-pitting small roller specimen shown in FIG. 3 (dimensions shown in FIG. 3 are in millimeters), hereinafter, simply referred to as a small roller specimen). In FIG. 3, "f" means a diameter (unit is mm). The small roller specimen illustrated in FIG. 3 includes a test part (a columnar part having a diameter of 26 mm and a width of 28 mm) at its center.

Figure 4:
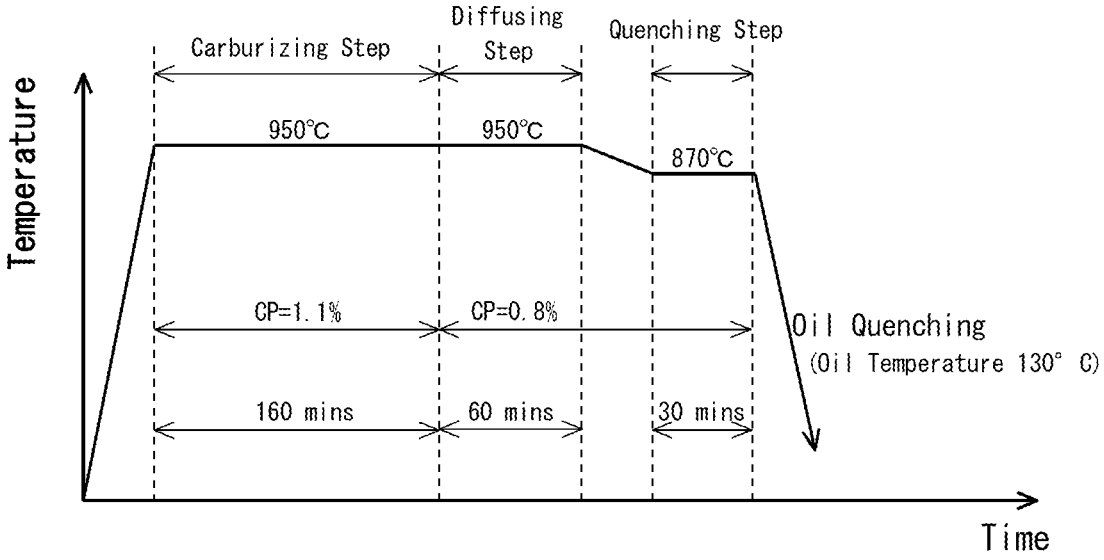
FIG. 4 is a heating pattern chart of carburizing treatment performed on the small roller specimen.

Each fabricated test specimen was subjected to carburizing treatment and quenching treatment (carburizing and quenching treatment) using a gas carburizing furnace under conditions shown in FIG. 4. After the quenching treatment, the test specimen was subjected to tempering at 150° C. for 90 minutes to be fabricated into the small roller specimen being the carburized-steel component.

Figure 5:
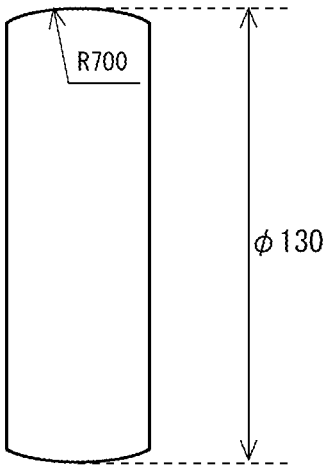
FIG. 5 is a front view of a large roller specimen used in a roller-pitting test in Examples.

In a roller-pitting test, the small roller specimen having a shape illustrated in FIG. 3 and a large roller having a shape illustrated in FIG. 5 (dimensions shown in FIG. 5 are in millimeters) were used in combination. The large roller illustrated in FIG. 5 had a chemical composition satisfying specification of SCM420 in JIS G 4053(2016) and specifically had a chemical composition shown as Test No. 33 in Table 1. The large roller was produced by performing a hot working step under the same conditions as those of Test Nos.

1 to 32, then processed into the shape illustrated in FIG. 5, and then subjected to the carburizing and quenching treatment illustrated in FIG. 4 and tempering at 150° C. for 90 minutes.

A roller-pitting test using the small roller specimen and the large roller was conducted under conditions shown in Table 3.

TABLE 3

| | |
|---|---|
| Testing machine | Roller-pitting testing machine |
| Test specimen | Small roller: 26 mm diameter<br>Large roller: 130 mm diameter<br>(700 mmR in contact portion) |
| Maximum interfacial pressure | 4000 MPa |
| Number of tests | 6 |
| Slip factor | −40% |
| Rotational speed of small roller | 1000 rpm |
| Peripheral speed | Small roller: 1.36 m/s<br>Large roller: 1.90 m/s |
| Lubricant temperature | 90° C. |
| Lubricant used | Oil for automatic transmission |

As shown in Table 3, a rotational speed of the small roller specimen was set at 1000 rpm, a slip factor was set at −40%, a contact interfacial pressure between the large roller and the small roller specimen in the test was set at 4000 MPa, and the number of cycles was set at $2.0\times10^7$. Let V1 (m/sec) denote the rotation speed of the large roller and V2 (m/sec) denote the rotation speed of the small roller specimen, the slip factor (%) is calculated by the following formula.

$$\text{Slip factor}=(V2-V1)V2\times100$$

In the test, lubricant (commercial oil for automatic transmission) was sprayed onto a contact portion between the large roller and the small roller specimen (a surface of the test part) in an opposite direction to a rotation direction under a condition of an oil temperature being 90° C. The roller-pitting test was performed under the conditions described above to evaluate roller-pitting fatigue strength.

For each test number, the number of tests in the roller-pitting test was set at six. After the test, an S—N diagram with its ordinate representing the interfacial pressure and its abscissa representing the number of cycles with which pitting occurred was created. Of interfacial pressures of tests in which pitting did not occur until the number of cycles of $2.0\times10^7$, a highest interfacial pressure was defined as a roller-pitting fatigue strength of a test number. A case where a largest one of damaged spots on a surface of the small roller specimen had an area of 1 $mm^2$ or more was determined as occurrence of pitting.

Table 2 shows roller-pitting fatigue strengths resulting from the test. For the roller-pitting fatigue strengths in Table 2, a roller-pitting fatigue strength of a carburized-steel component that is produced by performing carburizing treatment on a steel material having a chemical composition satisfying specifications of SCR420 in JIS G4053(2016), which is a typical, conventional steel type, (Test No. 29) was used as a reference value (100%). A roller-pitting fatigue strength of each test number is shown in a form of a ratio (%) to the reference value. When the roller-pitting fatigue strength was 120% or more, it was determined that an excellent roller-pitting fatigue strength was obtained.

[Evaluation Test for Hydrogen Embrittlement Resistance]

Figure 6:
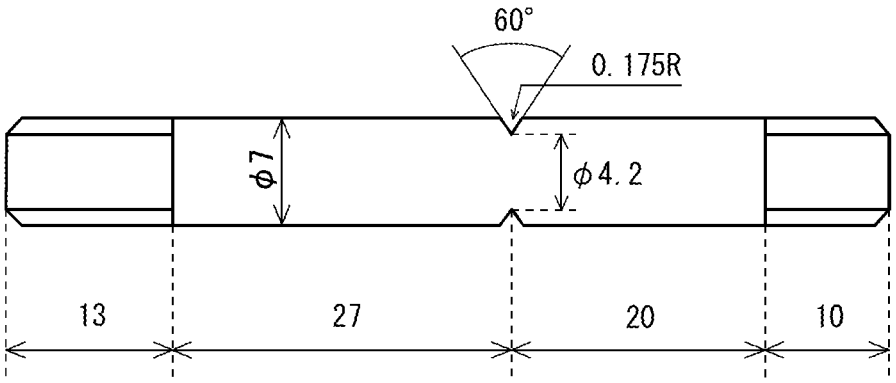
FIG. 6 is a side view of an annular V-notch test specimen used in a roller-pitting fatigue test.

The steel material of each test number (the steel bar having a diameter of 80 mm) was machined to be fabricated into an annular V-notch test specimen illustrated in FIG. 6. Numeric values in FIG. 6 not accompanied by units indicate dimensions (in mm) of corresponding regions of the test specimen. In FIG. 6, indications of "ϕ numeric value" each indicate a diameter (mm) of a specified region. An indication of "60°" indicates that a V notch angle is 60°. An indication of "0.175R" indicates that a V notch root radius is 0.175 mm. A longitudinal direction of the annular V-notch test specimen was parallel to the longitudinal direction of the steel bar. A central axis of the annular V-notch test specimen substantially matched an R/2 position of the steel bar.

The fabricated annular V-notch test specimen was subjected to the carburizing and quenching treatment using a gas carburizing furnace under the conditions shown in FIG. 4. The test specimen subjected to the quenching was tempered at 150° C. for 90 minutes to be fabricated into a test specimen equivalent to the carburized-steel component.

By an electrolytic charging method, hydrogen was introduced to a test specimen of each test number at various concentrations. The electrolytic charging method was performed as follows. A test specimen was immersed in ammonium thiocyanate aqueous solution. With the test specimen being immersed, an anode potential was generated on a surface of the test specimen, by which hydrogen was brought into the test specimen.

After the hydrogen was introduced into the test specimen, a zinc plating coating was formed on the surface of the test specimen to prevent the hydrogen in the test specimen from being dissipating. Subsequently, a constant load test was conducted in such a manner that a constant load is posed on the test specimen so that a tensile stress being a nominal stress of 1080 MPa (90% of a tensile strength) is posed on a V-notch cross section of the test specimen. The programmed temperature gas chromatography using a gas chromatography device was performed on test specimens that were ruptured during the test and test specimens that were not ruptured during the test, to measure hydrogen amounts in the test specimens. After the measurement, a maximum hydrogen amount of the test specimens that were not ruptured was defined as a critical diffusible hydrogen amount He for each test number.

In addition, a critical diffusible hydrogen amount of the steel material that is produced by performing carburizing treatment on the steel material having the chemical composition satisfying specifications of SCR420 in JIS G4053 (2016) (Test No. 29) was determined as a reference (Href) of a critical diffusible hydrogen amount ratio HR. The critical diffusible hydrogen amount ratio HR was determined with reference to the critical diffusible hydrogen amount Href, by Formula (A).

$$HR=Hc/Href \quad (A)$$

A case where the critical diffusible hydrogen amount ratio HR was 1.10 or more was determined to be excellent in hydrogen embrittlement resistance.

[Test Results]

Referring to Table 1 and Table 2, chemical compositions of steel materials of Test Nos. 1 to 11, 28, and 30 to 32 were within the range of the chemical composition according to the present embodiment and satisfied Formula (1) to Formula (5). As a result, their critical compression ratios were 68% or more, showing sufficient critical working ratios. Furthermore, fatigue strength ratios of their steel materials (carburized-steel components) subjected to the carburizing treatment were 120% or more, and thus the steel materials had excellent fatigue strengths. Furthermore, critical diffusible hydrogen amount ratios HR of their steel materials (carburized-steel components) subjected to the carburizing treatment were 1.10 or more, and thus the steel materials showed excellent hydrogen embrittlement resistances. Their steel materials for a carburized-steel component each had a carburized layer having a depth of at least 0.4 mm or more. Vickers hardnesses of their carburized layers at the 50 μm depth position were 650 to 1000 HV, and Vickers hardnesses of their core portions at the 10.0 mm depth position were 250 to 500 HV; therefore, their carburized layers and core portions both had sufficient hardnesses.

In contrast, in Test No. 12, its F1 was more than an upper limit of Formula (1). As a result, a critical working ratio of its steel material for a carburized-steel component was low.

In Test No. 13, its content of C was too low. As a result, a hardness of its carburized-steel component at the 10 mm depth position was too low.

In Test No. 14, its content of C was too high, and its F1 was more than the upper limit of Formula (1). As a result, a critical working ratio of its steel material for a carburized-steel component was low.

In Test No. 15, its F2 was less than a lower limit of Formula (2). As a result, a hardness of its carburized-steel component at the 10 mm depth position was too low.

In Test No. 16, its F2 was more than an upper limit of Formula (2). As a result, a critical working ratio of its steel material for a carburized-steel component before forging was too low.

In Test No. 17, its F3 was less than a lower limit of Formula (3). As a result, part of prior-austenite grains became coarse grains in a core portion of its carburized component.

In Test No. 18, its F3 was more than an upper limit of Formula (3). As a result, a critical working ratio of its steel material for a carburized-steel component was low.

In Test No. 19, its F4 was less than a lower limit of Formula (4). As a result, a critical working ratio of its steel material for a carburized-steel component was low.

In Test No. 20, its F4 was more than an upper limit of Formula (4). As a result, a critical working ratio of its steel material for a carburized-steel component was low.

In Test No. 21, its content of Ti was too high. As a result, a critical working ratio of its steel material for a carburized-steel component was low.

In Test No. 22, its content of Ca was too high. As a result, a critical working ratio of its steel material for a carburized-steel component was low.

In Test No. 23, its content of Ca was too low. As a result, a critical working ratio of its steel material for a carburized-steel component was low.

In Test No. 24, its content of Si was too low. As a result, a fatigue strength of its carburized-steel component was low.

In Test No. 25, its content of S was low, and its content of Ca was too low. As a result, a critical working ratio of its steel material for a carburized-steel component was low.

In Test No. 26, its F5 did not satisfy Formula (5). As a result, its critical diffusible hydrogen amount ratio HR was less than 1.10, showing a low hydrogen embrittlement resistance.

In Test No. 27, its content of Mn was too low. As a result, a hardness of its carburized-steel component at the 10 mm depth position was too low, and a fatigue strength of the carburized-steel component was low.

In Test No. 34, its F2 was more than the upper limit of Formula (2). As a result, a critical working ratio of its steel material for a carburized-steel component before forging was too low.

In Test No. 35, its F3 was less than the lower limit of Formula (3). As a result, part of prior-austenite grains became coarse grains in a core portion of its carburized component.

In Test No. 36, its F3 was more than the upper limit of Formula (3). As a result, a critical working ratio of its steel material for a carburized-steel component was low.

In Test No. 37, its F4 was less than the lower limit of Formula (4). As a result, a critical working ratio of its steel material for a carburized-steel component was low.

In Test Nos. 38 and 39, their F5 did not satisfy Formula (5). As a result, its critical diffusible hydrogen amount ratio HR was less than 1.10, showing a low hydrogen embrittlement resistance.

An embodiment according to the present invention is described above, but this embodiment described above is merely an example of practicing the present invention. The present invention is therefore not limited to the embodiment described above, and the embodiment described above can be modified and practiced as appropriate without departing from the scope of the present invention.

The invention claimed is:

1. A steel material having a chemical composition consisting of, in mass %:

C: 0.07 to 0.13%;
Si: 0.15 to 0.35%;
Mn: 0.60 to 0.80%;
S: 0.005 to 0.050%;
Cr: 1.90 to 2.50%;
B: 0.0005 to 0.0100%;
Ti: 0.010 to less than 0.050%;
Al: 0.010 to 0.100%;
Ca: 0.0002 to 0.0030%;
N: 0.0080% or less;
P: 0.050% or less;
O: 0.0030% or less;
Nb: 0 to 0.100%;
V: 0 to 0.300%;
Mo: 0 to 0.500%;
Ni: 0 to 0.500%;
Cu: 0 to 0.500%;
Mg: 0 to 0.0035%; and
rare earth metal (REM): 0 to 0.005%,
with the balance being Fe and impurities, and
satisfying Formula (1) to Formula (5):

$$0.140<C+0.194\times Si+0.065\times Mn+0.012\times Cr+0.033\times Mo+0.067\times Ni+0.097\times Cu+0.078\times Al<0.235 \quad (1)$$

$$1.35<(1.33\times C-0.1)+(0.23\times Si+0.01)+(0.42\times Mn+0.22)+(0.27\times Cr+0.22)+(0.77\times Mo+0.03)+(0.12\times Ni+0.01)<1.55 \quad (2)$$

$$0.004<Ti-N\times(48/14)<0.030 \quad (3)$$

$$0.03\leq Ca/S\leq 0.15 \quad (4)$$

$$Mn/(Si+Cr+Mo+Ni)<0.30 \quad (5)$$

where a symbols of each element in Formula (1) to Formula (5) is to be substituted by contents of the corresponding element (mass %) or to be substituted by "0" when the corresponding element is not contained.

2. A steel material having a chemical composition consisting of, in mass %:

C: 0.07 to 0.13%;
Si: 0.15 to 0.35%;
Mn: 0.60 to 0.80%;
S: 0.005 to 0.050%;

Cr: 1.90 to 2.50%;
B: 0.0005 to 0.0100%;
Ti: 0.010 to less than 0.050%;
Al: 0.010 to 0.100%;
Ca: 0.0002 to 0.0030%;
N: 0.0080% or less;
P: 0.050% or less;
O: 0.0030% or less;
one or more elements selected from the group consisting of:
Nb: 0.002 to 0.100%;
V: 0.001 to 0.300%;
Mo: 0.005 to 0.500%;
Ni: 0.005 to 0.500%;
Cu: 0.005 to 0.500%;
Mg: 0.0001 to 0.0035%; and
rare earth metal (REM): 0.001 to 0.005%
with the balance being Fe and impurities, and satisfying Formula (1) to Formula (5):

$$0.140<C+0.194\times Si+0.065\times Mn+0.012\times Cr+0.033\times Mo+0.067\times Ni+0.097\times Cu+0.078\times Al<0.235 \quad (1)$$

$$1.35<(1.33\times C-0.1)+(0.23\times Si+0.01)+(0.42\times Mn+0.22)+(0.27\times Cr+0.22)+(0.77\times Mo+0.03)+(0.12\times Ni+0.01)<1.55 \quad (2)$$

$$0.004<Ti-N\times(48/14)<0.030 \quad (3)$$

$$0.03\leq Ca/S\leq 0.15 \quad (4)$$

$$Mn/(Si+Cr+Mo+Ni)<0.30 \quad (5)$$

where a symbols of each element in Formula (1) to Formula (5) is to be substituted by contents of the corresponding element (mass %) or to be substituted by "0" when the corresponding element is not contained.

* * * * *